US005540148A

United States Patent [19]

Oumiya et al.

[11] Patent Number: 5,540,148

[45] Date of Patent: Jul. 30, 1996

[54] PRINTING DEVICE AND DIE-CUTTING DEVICE

[75] Inventors: Nobuyoshi Oumiya, Saitama-ken; Kazuhiko Sato, Sakado; Tadayoshi Iharagumi, Tsurugashima; Iwao Nakajima, Urawa; Nobuyoshi Itaki, Toda; Yuji Takeda, Kawaguchi, all of Japan

[73] Assignee: Lintec Co., Ltd., Tokyo, Japan

[21] Appl. No.: 329,224

[22] Filed: Oct. 26, 1994

Related U.S. Application Data

[63] Continuation-in-part of Ser. No. 161,309, Dec. 2, 1993, abandoned, which is a continuation of Ser. No. 947,728, Sep. 18, 1992, abandoned.

[30] Foreign Application Priority Data

| | | | |
|---|---|---|---|
| Sep. 19, 1991 | [JP] | Japan | 3-084303 |
| Sep. 19, 1991 | [JP] | Japan | 3-084305 |
| Sep. 19, 1991 | [JP] | Japan | 3-268501 |
| Sep. 19, 1991 | [JP] | Japan | 3-268502 |
| Sep. 19, 1991 | [JP] | Japan | 3-268503 |

[51] Int. Cl.[6] ..... B41F 17/00

[52] U.S. Cl. ..... 101/212; 101/227; 101/355

[58] Field of Search ..... 101/212, 219, 101/349, 350, 269, 353, 354, 355, 357, 358, 282, 252, 256, 257, 264, 253, 133, 146, 227, 224, 226

[56] References Cited

U.S. PATENT DOCUMENTS

| | | | |
|---|---|---|---|
| 2,178,465 | 10/1939 | Behrens | 101/260 |
| 3,934,506 | 1/1976 | Levy et al. | 101/260 |
| 4,057,013 | 11/1977 | Asano | 101/212 |
| 4,135,664 | 1/1979 | Resh | 235/475 |
| 4,346,855 | 8/1982 | Biggar, III | 242/67.2 |
| 4,681,004 | 7/1984 | Waldner | 83/98 |
| 4,691,630 | 9/1987 | Asano | 101/212 |
| 4,967,379 | 10/1990 | Ott . | |
| 5,042,352 | 8/1991 | Lux | 83/690 |
| 5,182,721 | 1/1993 | Kipphan et al. . | |

FOREIGN PATENT DOCUMENTS

| | | |
|---|---|---|
| 0228347 | 12/1986 | European Pat. Off. . |
| 0321402 | 12/1988 | European Pat. Off. . |
| 90122962 | 6/1991 | European Pat. Off. . |
| 8434304 U | 6/1987 | Germany . |
| 59-162505 | 2/1986 | Japan . |

*Primary Examiner*—J. Reed Fisher
*Attorney, Agent, or Firm*—Biebel & French

[57] ABSTRACT

A printing device of the type for printing a strip-like printing article having a printing impression roller which is movable forwards while rotating in one direction and backwards while rotating in the opposite direction, along a line perpendicular to the direction of feeding a strip-like printing article is provided with a slide base which is slidable along rails which extend in a direction perpendicular to the direction of feeding of the printing article. Ink tanks and a roller train are mounted on the slide base. The roller train includes an ink fountain roller, a duct roller whose peripheral surface is in contact with the ink fountain roller, a stationary metallic roller whose peripheral surface is in contact with the duct roller, a first ink distribution roller whose peripheral surface is in contact with the metallic roller, and a second ink distribution roller whose peripheral surface is in contact with the first ink distribution roller. The contact between the first ink distribution roller and the second ink distribution roller of the roll train with ink rollers is separated by the movement of the slide base.

5 Claims, 22 Drawing Sheets

PRINTING DEVICE AND DIE-CUTTING DEVICE

REFERENCE TO RELATED APPLICATION

This is a continuation-in-part application of U.S. patent application Ser. No. 08/161,309, filed Dec. 2, 1993, now abandoned, which is a continuation application of U.S. patent application Ser. No. 07/947,728, filed Sep. 18, 1992, now abandoned.

BACKGROUND OF THE INVENTION

1. Field of the Invention

The present invention relates to a printing device and, in particular, to a printing device for printing a strip-like printing article (i.e., an article to be printed) of the type in which printing is intermittently performed on the printing article by a printing impression roller which moves forwards in a direction perpendicular to a direction of feeding the strip-like printing article while rotating in one direction and moves backwards while rotating in the opposite direction. The present invention also relates to a die-cutting device which die-cuts or punches into a desired shape a strip-like printed article printed by a printing device as described above.

2. Description of Related Art

A printing device of the above-described type has been known, e.g., from U.S. Pat. No. 4,057,013 and U.S. Pat. No. 4,691,630. Although low in printing speed, the printing device of this type is simple in construction, relatively small in size and is suitable for multicolor printing of a small number of printing articles such as labels. Further, since the strip-like printing article is kept flat and is not subjected to bending during the printing process, it has been utilized for printing a printing article such as a label, as shown in FIG. 2, which has a construction made up of relatively thick multiple layers having an adhesive agent layer.

A conventional printing device of this type has the following construction as schematically shown in FIG. 25. Namely, a printing block 56*a* having a plurality of printing stamps for printing a plurality of different colors is fixed to a single printing impression roller (or a printing roller) 38*a*. The strip-like printing article S1*a* is moved by intermittently feeding by a distance corresponding to each printing stamp. While the feeding is temporarily stopped, the printing impression roller 38*a* is moved forwards or backwards in a direction perpendicular to the direction of feeding the strip-like printing article S1*a*, thereby printing the strip-like printing article S1*a*. On the printing portion on a single frame of the printing article S1*a*, there are sequentially printed a plurality of colors by means of the plurality of printing stamps which are provided on the printing block 56*a*. It is thus so arranged that the multicolor printing in each frame is completed when the printing article S1*a* has passed through the area in which the printing impression roller 38*a* moves forwards and backwards.

In this conventional printing device, in order to apply inks from upper ink tanks 12*a* to the printing impression roller 38*a*, there is provided in a stationary positional relationship a roller train 48*a* which is made up, as shown in FIGS. 26A through 26C, of a metallic ink fountain roller (or bottling roller) 13*a* which feeds inks from the ink tanks 12*a*, a rubber duct roller (or access roller) 15*a* which rotates in contact with the periphery of the ink fountain roller 13*a*, and a group of ink distribution rollers (or ink kneading rollers) 47*a* which are disposed between the duct roller 15*a* and two metallic ink rollers (or inking rollers) 16*a*, 17*a* and which are made up of a plurality of rubber rollers 45*a* and metallic rollers 46*a* whose peripheries are held in consecutive contact with each other. In order to supply inks to the two ink rollers 16*a*, 17*a*, the roller train 48*a* is divided into two on the way to the ink rollers 16*a*, 17*a*. If necessary, there are also provided rollers 49*a*, 49*a*, in a stationary relationship, between the two ink rollers 16*a*, 17*a*, as shown in FIGS. 26A and 26C, in order to equalize the amounts of inks. In this roller train 48*a*, the ink fountain roller 13*a* is driven by an electric motor. The duct roller 15*a* is swung into alternate contact with the ink fountain roller 13*a* and one of the group of the ink distribution rollers 47*a* so as to transfer the inks. The metallic rollers 46*a* among the group of the ink distribution rollers 47*a* and the two ink rollers 16*a*, 17*a* are driven by electric motors, and the rubber rollers 45*a* are rotated by coming into frictional contact with these motor-driven rollers. On the peripheral surface of each of the ink rollers 16*a*, 17*a* a rubber form roller (or an ink application roller of rubber make) 41*a* is respectively rotated through frictional contact therewith. Each of the form rollers 41*a* is mounted on a swinging arm whose operation is controlled by a cam mechanism. By the swinging movement of the form rollers 41*a*, the bottom portions of the form rollers 41*a* are brought into intermittent contact with the printing impression roller 38*a* which moves forwards and backwards under the ink rollers 16*a*, 17*a* in the direction of an arrow X in FIG. 25. The inks are thus applied from the ink rollers 16*a*, 17*a* to the printing blocks 56*a* of the printing impression roller 38*a*. For example, in the conventional example shown in FIG. 26A, the printing impression roller 38*a* advances while rotating from the right side or the left side which is perpendicular to the direction of feeding of the strip-like printing article S1*a* which is fed, on a flat printing pressuring base 36*a*, in a direction perpendicular to the surface of the figure sheet, thereby printing on the printing surface of the strip-like printing article S1*a*. Before the printing impression roller 38*a* reaches the printing article S1*a*, the form rollers 41*a* are kept waiting by swinging forwards in the travelling directions. The printing impression roller 38*a* pushes the form rollers 41*a* while pushing them upwards through rotational contact therewith. At the time of their contact, the inks on the peripheries of the form rollers 41*a* are applied or coated to the printing block 56*a* of the printing impression roller 38*a*. The rollers of the roller train 48*a* are provided to coat the inks to be supplied from the ink tanks 12*a* to the ink rollers 16*a*, 17*a* to a uniform thickness. While the inks are transmitted through respective rollers which are in rotational contacts with each other, unevenness of the ink distribution disappears.

In case printing of three colors is performed on the strip-like printing article S1*a*, a printing block 56*a* having three kinds of stamps, for example, is mounted on the printing impression roller 38*a* as shown in FIG. 25. The ink tanks 12*a* which are divided so as to be able to contain therein three colors of inks are also prepared. The inks to be fed from the ink tanks 12*a* are transmitted in the form of stripes or bands of three colors as divided in the longitudinal or axial direction of each roller. The ink rollers 16*a*, 17*a* are thus uniformly coated with each color of inks. These three colors of inks are respectively coated on the three stamps of the printing block 56*a* by means of the form rollers 41*a*. In the example shown in FIG. 25, since the stamps of the printing block 56*a* are three in number, there will be carried out a simultaneous printing of three frames each time the printing impression roller 38*a* rolls on the printing article S1*a*. Whenever one step or one time of printing work has been finished, the strip-like printing article S1*a* is intermittently fed by a suitable intermittent feeding means by a distance which is equivalent to the length of one frame and a distance between the frames. When three times of intermittent feeding have been finished, one unit of the printing process will be finished.

In case a label of released adhesion type is manufactured, there is used a strip-like printing article S1*a*, as shown in FIG. 2, in which a released paper is multiplied (or added) via an adhesive (mainly pressure sensitive adhesive) agent layer, on the rear surface of a printing paper. After the above-described printing process has been finished, a transparent adhesive film, for example, is laminated on the printed surface. The transparent adhesive film, the printing paper and the adhesive agent layer except for the released paper are die-cut (or cut by die-cutting) along the above-described frame. An unnecessary portion of the printing paper is released from the released paper together with the adhesive agent layer and the transparent adhesive film, thereby obtaining labels provided with a released paper. The die-cutting device for performing this die-cutting work has a construction as shown in FIGS. 27 and 28. Namely, a lower chase plate 129*a* is mounted on a substantially horizontal upper surface of a stationary lower frame 103*a*. To a lower surface of an upper frame 102*a* which is screwed to four supporting columns 107*a* which can move up and down through a vertical movement mechanism of a crank or the like, there is fixed an upper chase plate 105*a* which is made of a thick steel plate and is provided on its lower surface with a punching or die-cutting blade 104*a*. The upper chase plate 105*a* is arranged to be movable towards and away from the upper surface of the lower chase plate 129*a*. The strip-like printed article S2*a* which has been printed is intermittently fed to a space between the upper chase plate 105*a* and the lower chase plate 129*a* with the printed surface looking upwards. While the feeding is stopped, the upper frame 102*a* is lowered so that the punching blade 104*a* of the upper chase plate 105*a* comes into cutting engagement with the surface of the strip-like printed article S2*a*, thereby die-cutting it except the released paper. The punching blade 104*a* is made by continuously arranging a thin blade into a square, a circle or the like shape corresponding to the shape of the outline of the printing frame. When the outline of the printing frame has been changed in shape, the shape of the punching blade is also changed.

In order to enable the adjustment of the punching blade 104*a*, the upper chase plate 105*a* is mounted so as to be movable back and forth along a pair of guide rails 108*a* of substantially L-shape in cross section which are provided on both sides of a rotatable plate 109*a* which is rotatable by a rotation-adjustment bolt 110*a* relative to the upper frame 102*a*. After rotation adjustment, it is immovably fixed by a suitable fixing means. In case the shape of the punching blade 104*a* is changed, the upper chase plate 105*a* is pulled out of the rails 108*a* of the rotatable plate 109*a* and then a replacement work of the punching blade is performed. The punching blade 104*a* is normally fixed to the upper chase plate 105*a* with a pressure sensitive adhesive double coated tape.

In case printing of different colors or pattern is to be made on another strip-like printing article S1*a* after having finished the printing on one strip-like printing article S1*a*, the following procedure must be followed. Namely, the printing block 56*a* on the printing impression roller 38*a* is replaced. The ink tanks 12*a*, the rollers of the roller train 48*a*, the ink rollers 16*a*, 17*a* and the form rollers 41*a* are cleaned by letting a cleaning liquid flow from the ink tanks 12*a* downwards into a pan which is prepared below the form rollers 41*a*. Then, the ink tanks 12*a* are filled with new inks and the inks are distributed or kneaded by rotating all the rollers between the ink tanks 12*a* and the form rollers 41*a* until the inks are uniformly coated on the ink rollers 16, 17. When a condition in which the form rollers 41*a* have no more uneven distribution of the inks has been attained, the printing work is started. In the conventional printing device, the number of rollers which are present between the ink tanks 12*a* and the ink rollers 16*a*, 17*a*, i.e., those which constitute the roller train 48*a* is large. Therefore, it takes long time before the inks reach the ink rollers 16*a*, 17*a* and there was a disadvantage in that the time of distributing the inks becomes long. In order to shorten this time, the speed of rotation of the rollers may be increased. However, the inks may splash from many points of contacts among rollers, with the result that the printing device is stained inside, giving rise to a possibility of staining the printing article S1*a*. In addition, the rollers may be heated through an increase in the number of frictional rotation, which may give rise to a cause of mechanical troubles or change (or deterioration) in color of the inks, which is of course to be avoided.

As described above, in these rollers there are used rubber rollers and metallic rollers. In FIGS. 26A through 26C, the hatched rollers are of rubber make and the remaining rollers are of metallic make. Each of the rubber rollers is provided with dented grooves 49*a* as shown in FIG. 29. For example, in the case of the ink fountain roller 15*a* for three colors, the roller is divided, as shown therein, into three sections as divided in the longitudinal or axial direction with a groove 49*a* in between so that the inks of different colors to be adhered to the three surfaces do not get mixed. The metallic rollers have no such grooves because they have smoother surfaces than those of the rubber rollers and consequently the inks have no tendency of spreading sidewise. In case the number of colors is changed from three to four, the rubber rollers must be changed to those whose surfaces are divided into four sections. However, the stationary roller arrangement like in FIGS. 26A through 26C has a large number of rollers and is time consuming in their replacement. During this replacement work, the printing device cannot be operated and the printing device is therefore poor in operating efficiency. When the number of colors has been changed, the same kind of cleaning work as has been explained hereinabove is made before the replacement work in order to clean the metallic rollers such as the ink rollers 16*a*, 17*a* that have not been replaced. Thereafter, predetermined inks are prepared in the ink tanks 12*a* and these rollers are rotated to distribute the inks. The printing work will be started after the inks have been distributed.

In case the strip-like printing article S1*a* is in the form of labels and their printing dimensions and shape have been changed, the punching blade 104*a* for die-cutting is also replaced accordingly by taking it out of the rails 108*a* together with the upper chase plate 105*a*. The punching blade 104*a* must also be pulled out when checking thereof must be done during the die-cutting work. However, since the upper chase plate 105*a* is made of a metal and is therefore very heavy, there is a possibility of inadvertently dropping it out of position or onto the floor when the upper chase plate 105*a* is pulled out.

In view of the foregoing disadvantages of the conventional printing device, the present invention has an object of providing a printing device of the type in which the printing impression roller moves forwards and backwards in a direction perpendicular to a direction of feeding a strip-like printing article, which printing device having an improved operating efficiency in that the replacement of the printing rollers can be made in a shorter time and that the cleaning of the rollers and the distribution of the inks can also be made in a shorter time, with a smaller amount of splashing of the inks. Another object of the present invention is to provide a printing device which is cheap in the cost of replacing the rollers and in the running cost. It is still another object of the present invention to provide a die-cutting device for die-cutting the strip-like printed article which has been printed by such a printing device as described above, which die-cutting device being of vertically movable type in which the punching blade to die-cut the printed strip-like printed article can be replaced or inspected safely and easily.

SUMMARY OF THE INVENTION

According to the present invention, the foregoing and other objects are attained by a printing device having: a printing impression roller which is movable forwards while rotating in one direction and backwards while rotating in an opposite direction, along a line perpendicular to a direction of feeding a strip-like printing article to be fed from a paper feeding device, such that printing on the printing article is performed intermittently during the forward and backward movements of said printing impression roller; a pair of ink rollers which are provided above the printing impression roller at a distance therefrom in parallel with a shaft thereof; a pair of form rollers which are swung to bring them into alternate contact with the printing impression roller and the pair of ink rollers, whereby an ink is applied by the form rollers to a printing impression of the printing impression roller; a roller train having an ink fountain roller, a duct roller and ink distribution rollers, the rollers coming into consecutive contact with each other; and an ink tank disposed above the roller train in contact with a peripheral surface of the ink fountain roller, whereby the ink contained in the ink tank is fed to the ink rollers via the roller train. The printing device has an improvement which comprises a slide base which is slidable along rails which extend in a direction perpendicular to the direction of feeding of the printing article and the ink tank and the roller train are mounted on the slide base. The roller train comprises the ink fountain roller, the duct roller whose peripheral surface is in contact with the ink fountain roller, a stationary metallic roller whose peripheral surface is in contact with the duct roller, a first ink distribution roller whose peripheral surface is in contact with the metallic roller, and a second ink distribution roller whose peripheral surface is in contact with the first ink distribution roller. The contact between the first ink distribution roller and the second ink distribution roller of the roll train with the ink rollers is separated by the movement of the slide base.

Preferably, the ink tank and the ink fountain roller are detachably mounted on the slide base.

Further, there may be provided a second slide base so as to mount thereon a second ink tank and a second roller train.

In accordance with another aspect of the present invention, the foregoing and other objects are attained by a die-cutting device having: an upper frame which is movable up and down; an upper chase plate which is disposed under the upper frame so as to be movable into and from underneath the upper frame along a line perpendicular to a direction of feeding a printed article which is made up of a released paper and a printing paper disposed on top of the released paper via an adhesive agent, the movement being guided at both side edges of the upper chase plate by a pair of guide rails which are provided so as to be movable up and down together with the upper frame; a stationary lower frame below the upper chase plate; a lower chase plate which is disposed on the lower frame, wherein the printed article is intermittently moved through a space between the upper frame and the lower frame; and a punching blade for punching a printed frame of the printed article, the punching blade being attached to a lower surface of the upper chase plate, the punching being carried out, while the feeding of the printed article is stopped, by moving downwards the upper frame, thereby cutting the printed paper and the adhesive agent layer. This die-cutting device has an improvement which comprises: a stopper shaft which is provided in a manner projecting on right and left sides of an end portion of the upper chase plate; a pair of slide arms which are provided in front of the guide rails, each of the slide arms having a receiving portion which slidably supports, by the side edges, the upper chase plate and a groove portion which extends in a direction of movement of the upper chase plate to allow for movement of the stopper shaft; a stopper which is provided in a front end of the groove portion to stop the movement of the stopper shaft by abutment therewith; and holding means which is provided on an upper portion of the slide arm and supports a rear surface of the upper chase plate when the upper chase plate is swung about the stopper shaft, which is in abutment with the stopper, into a posture at which the lower surface to which the punching blade is attached faces substantially upwards.

Preferably, the die-cutting device further comprises a rotatable plate which is provided below the upper frame so as to be rotatable relative to the upper frame, and wherein the guide rails and the slide arms are mounted on the rotatable plate with a distance between each of the respective pairs.

The printing work is carried out in the following manner. Namely, the strip-like printing article which has been fed from the paper feeding device is stopped in its feeding operation. The printing impression roller to which a printing block having, e.g., four stamps are attached is moved in a direction perpendicular to the direction of feeding of the strip-like printing article, thereby printing four frames of printing on the printing article. After the strip-like printing article is fed by a distance equivalent to the length of one frame and a clearance between the frames, the printing impression roller is moved backwards to thereby finish the printing of four frames. By repeating the above steps, the four-color printing is performed on the frames that have passed under or through the printing impression roller. Each time the printing impression roller is moved forwards and backwards, one of the form rollers which has been in contact with one of the ink rollers is swung to the front, as seen in the direction of movement, of the printing impression roller to thereby coat the printing block with inks. During the printing work, the inks are supplied from the ink tanks via the roller train to the ink rollers to a uniform thickness. This kind of operations are the same as the above-described conventional printing device.

In case printing of three colors of different printing patterns is to be made on the strip-like printing article once the printing of four colors, for example, on the strip-like printing article has been finished, next strip-like printing article is prepared on the paper (or web) feeding device. The slide base is moved from the printing position to change the inks and the rollers, and a work of distributing or kneading the inks is performed. In this work, the printing impression roller is positioned in an intermediate position of its forward and backward movement. The duct roller is brought into contact with the metallic roller and, thus, bring all the rollers from the duct roller to the ink roller into consecutive contact with each other. While contacting a doctor blade (not illustrated) with the ink roller, the ink roller is rotated by changing its rotation from one direction of rotation to the opposite direction of rotation, thereby washing away the ink adhered to the roller by means of a washing agent. Then, the slide base is moved to separate the contact between the roller train and the ink rollers. Then, the ink tanks and the ink fountain roller are taken out of the slide base. The duct roller and the rubber rollers of the two ink distribution rollers of the roller train are changed to those for three-color printing. The rubber form rollers are also changed to those for three-color printing and a new printing block is attached to the printing impression roller.

When the above-described replacement and cleaning of the rollers have been finished, ink tanks containing therein inks of predetermined three colors and new ink fountain roller are set on the slide base. The slide base is returned to a position in which the roller train and the ink rollers come into contact with each other. Thereafter, by rotating the ink rollers at a high speed, the ink distribution rollers are also rotated at a high speed, thereby performing the ink distribution. The high-speed rotation of the ink distribution rollers is also transmitted to the metallic roller in the roller train. The inks which are supplied from the freely rotating duct roller which alternately contacts the independently rotating ink fountain roller and the metallic roller, to the metallic roller are uniformly distributed. The form roller is also rotated at a high speed together with the ink roller. Once the inks have evenly distributed to the form rollers, the printing work is started by starting the forward and backward (i.e., reciprocating) movements of the printing impression roller and the intermittent feeding of the strip-like printing article. The ink distribution rollers which are positioned between the metallic roller and the ink rollers, both of which require no replacement, are separated from the ink rollers due to the movement of the slide base. Therefore, the replacement work of the ink distribution rollers becomes easy. Further, since the number of contacts among the rollers is small due to a smaller number of rollers which constitute the roller train the inks will not splash even if the rollers are rotated at a high speed for the purpose of ink distribution. It follows that the ink distribution can be finished in a shorter time. In addition, since the number of rollers is small, the replacement time also becomes short. The number of rollers to be prepared in advance for replacement also becomes small. As a result, the operating efficiency can be improved and the running cost can be reduced.

If two sets of slide bases are prepared and a roller train and ink tanks are mounted respectively on each of them, the next rollers can be prepared, during the printing work using one of the slide base, on the other of the slide bases which is kept waiting besides the printing device. In this case, as soon as the replacement of the form rollers and the cleaning of the ink rollers are finished, the printing work can be started, thereby attaining a higher operating efficiency.

In case the strip-like printing article is a multi-layer article such as a label, the strip-like printed article to be obtained by printing on the strip-like printing article is fed to the die-cutting device. By means of the punching blade which is attached to the upper chase plate of the upper frame which moves up and down, there are added to the strip-like printing article cutting lines conforming to the shape of the printed frame. In case the punching blade is either replaced due to the change in the printed frame or inspected, it is necessary to pull out the heavy upper chase plate from underneath the upper frame along the guide rails. When the upper chase plate is pulled out, the stopper shaft which projects to the right and left at the rear end portion of the upper chase plate stops by coming into abutment with the stopper on the slide arm. Then, the upper chase plate can be swung upwards to reverse the posture so as to support the rear surface thereof with the holding means on the slide arm. Thus, the punching blade which is attached to the lower surface of the upper chase plate can be held in a condition in which it looks slantingly upwards. The replacement work or the inspection work of the punching blade is performed in this condition. Since it is thus not necessary to remove the heavy upper chase plate completely out of the guide rails, there is no possibility of inadvertently dropping the upper chase plate out of position or onto the floor and therefore a safe replacement work or the like can be secured.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

A detailed explanation will now be made of one embodying example of the present invention with reference to the accompanying drawings.

Figure 1:
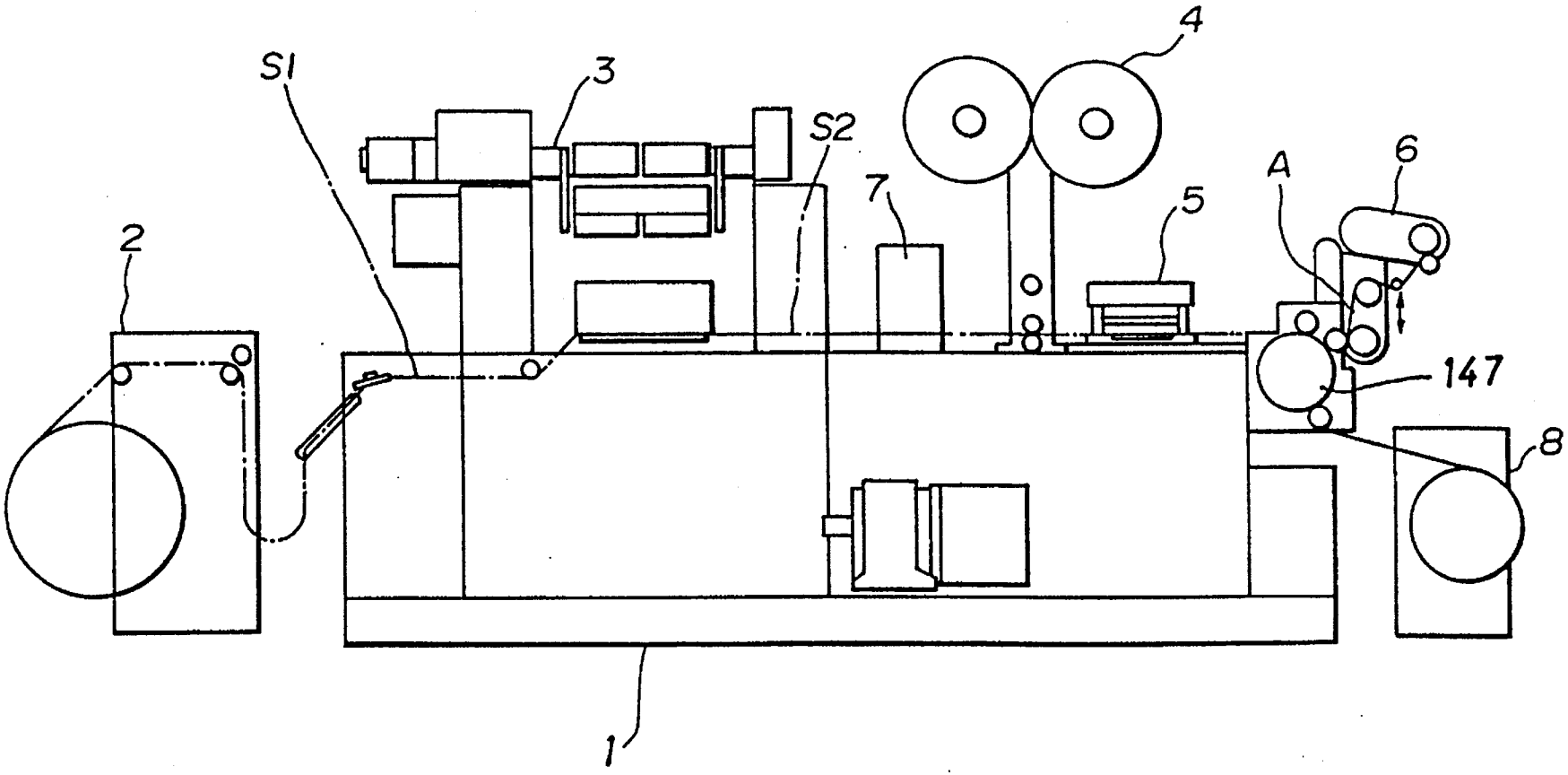
FIG. 1 is an overall front view of one embodying example of the present invention.
Figure 2:
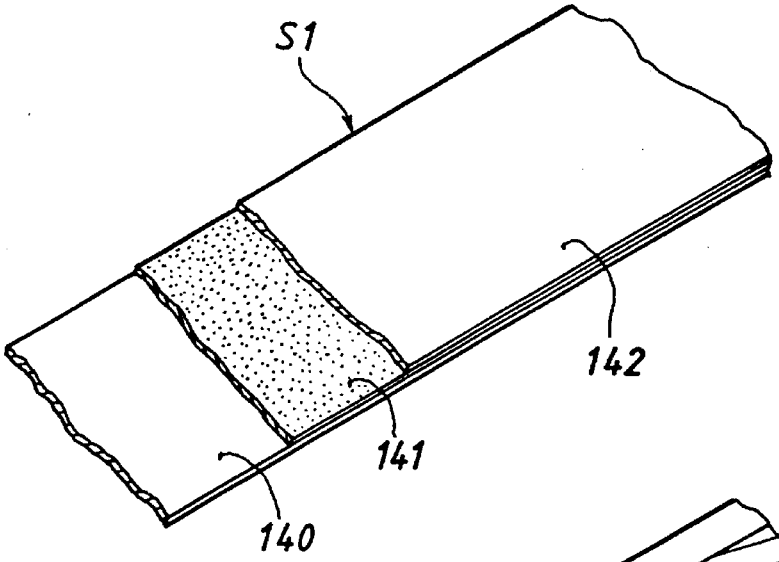
FIG. 2 is a partially cut away perspective view showing a construction of a strip-like printing article S1.
Figure 3:
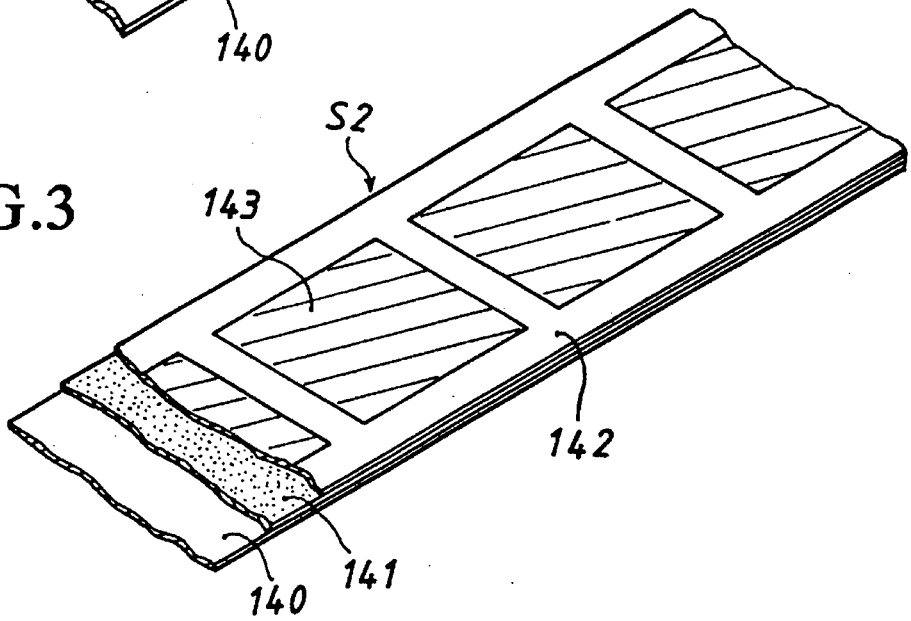
FIG. 3 is a partially cut away perspective view showing a construction of a strip-like printed article S2.
Figure 4:
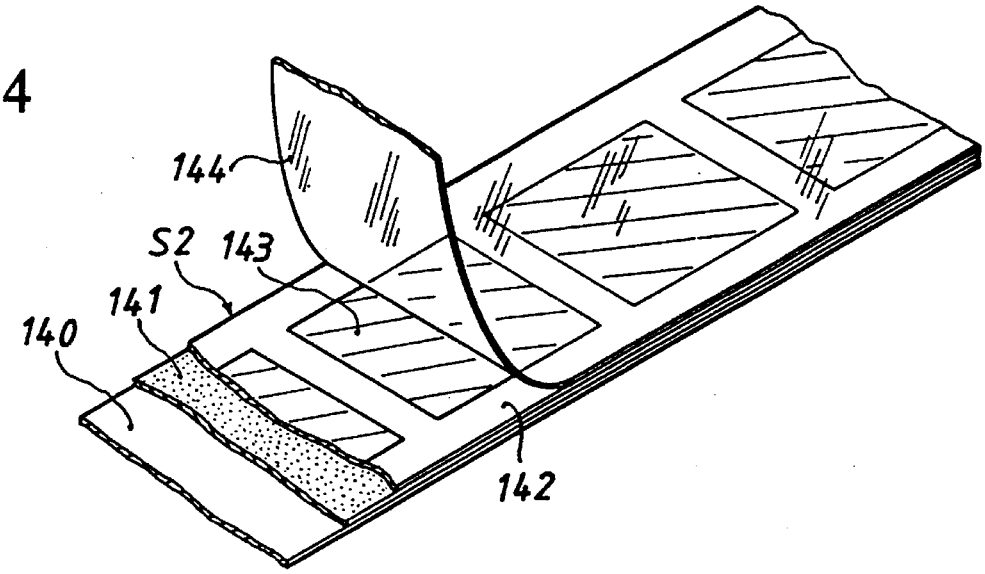
FIG. 4 is a perspective view showing a condition in which a transparent film is laminated on top of the strip-like printed article S2.
Figure 5:
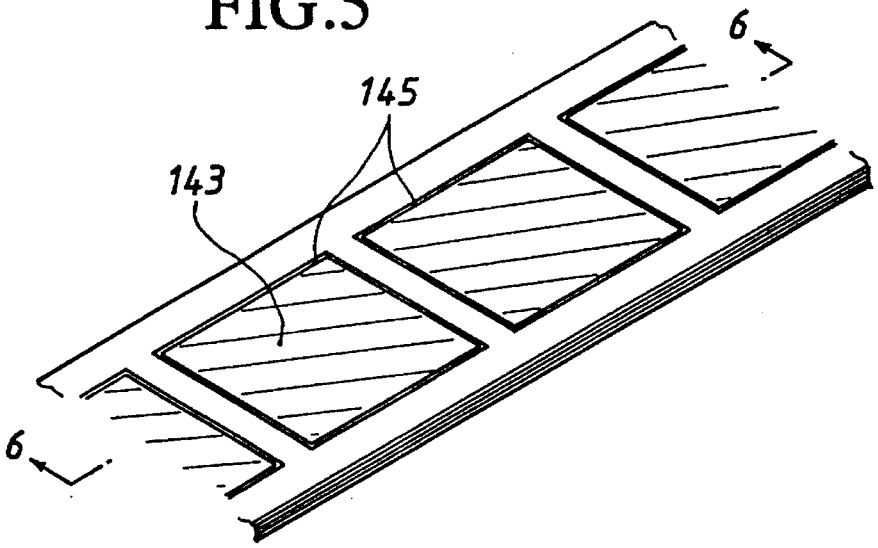
FIG. 5 is a perspective view of an important portion of the strip-like printed article which has been die-cut.
Figure 6:
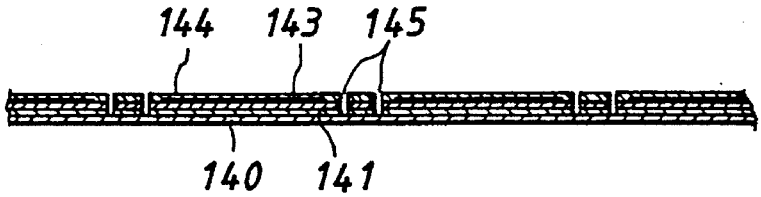
FIG. 6 is a sectional view taken along the line 6—6 in FIG. 5.
Figure 7:
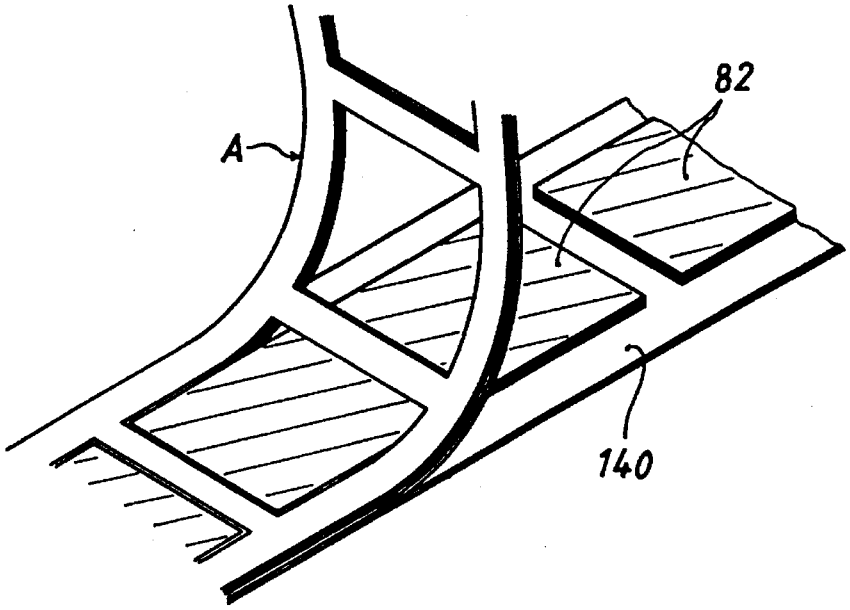
FIG. 7 is a perspective view showing a condition in which a punched residue A is peeled off the strip-like printed article S2.

An embodying example shown in FIG. 1 is one in which the present invention is applied to a printing apparatus 1 for manufacturing labels. In this printing apparatus 1, a strip-like printing article S1 which is supplied from a roll in a paper (or web) supplying device 2 is fed to a printing device 3 of the present invention to perform multicolor printing onto the printing article S1. After drying the printed inks in a drying mechanism (not illustrated), a strip-like printed article S2 is laminated on its surface with a transparent adhesive film by a laminating mechanism 4. The laminated printed article S2 is then die-cut or punched by a die-cutting device 5 into a suitable shape of labels. An unnecessary portion of the printed article other than the portion to be used as labels, i.e., a punched residue A is removed by winding it up by a punched residue winding device 6. A product in the form of labels is wound up by a product winding device 8. As a strip-like printing article S1 in this example, there is used a conventional label paper, as shown in FIG. 2, which is made up by overlapping, via an adhesive agent layer 141, a paper 142 on top of a released paper 140 having a released (or releasing) surface. According to this printing apparatus 1, a printed layer 143 is printed by the printing device 3 on the paper 142 as shown in FIG. 3. In the laminating mechanism 4, a transparent adhesive film 144 is laminated on top of the printed layer 143, as shown in FIG. 4. In the die-cutting device 5, there are added or given rectangular, round or similar cutting lines 145 in the paper 142, etc. except for the released paper 140 as shown in FIGS. 5 and 6. An unnecessary portion above (and inclusive of) the adhesive agent layer 141 other than the printed frames 82 to be used as labels, i.e., the punched residue or the refuse porion A is removed by releasing as shown in FIG. 7. The printed frames 82 to be used as labels, i.e., as final products are wound up together with the released paper 140 by a product winding device 8. An image processing device 7, which is described hereinafter, is also provided on the downstream side of the printing device 3 to photograph the strip-like printed article S2 to thereby detect the deviation of printing position and the change or deterioration in the printing colors. When the deviation in the printing position or the change in the printing colors has exceeded an allowable range, an instruction for correction is given.

Figure 8:
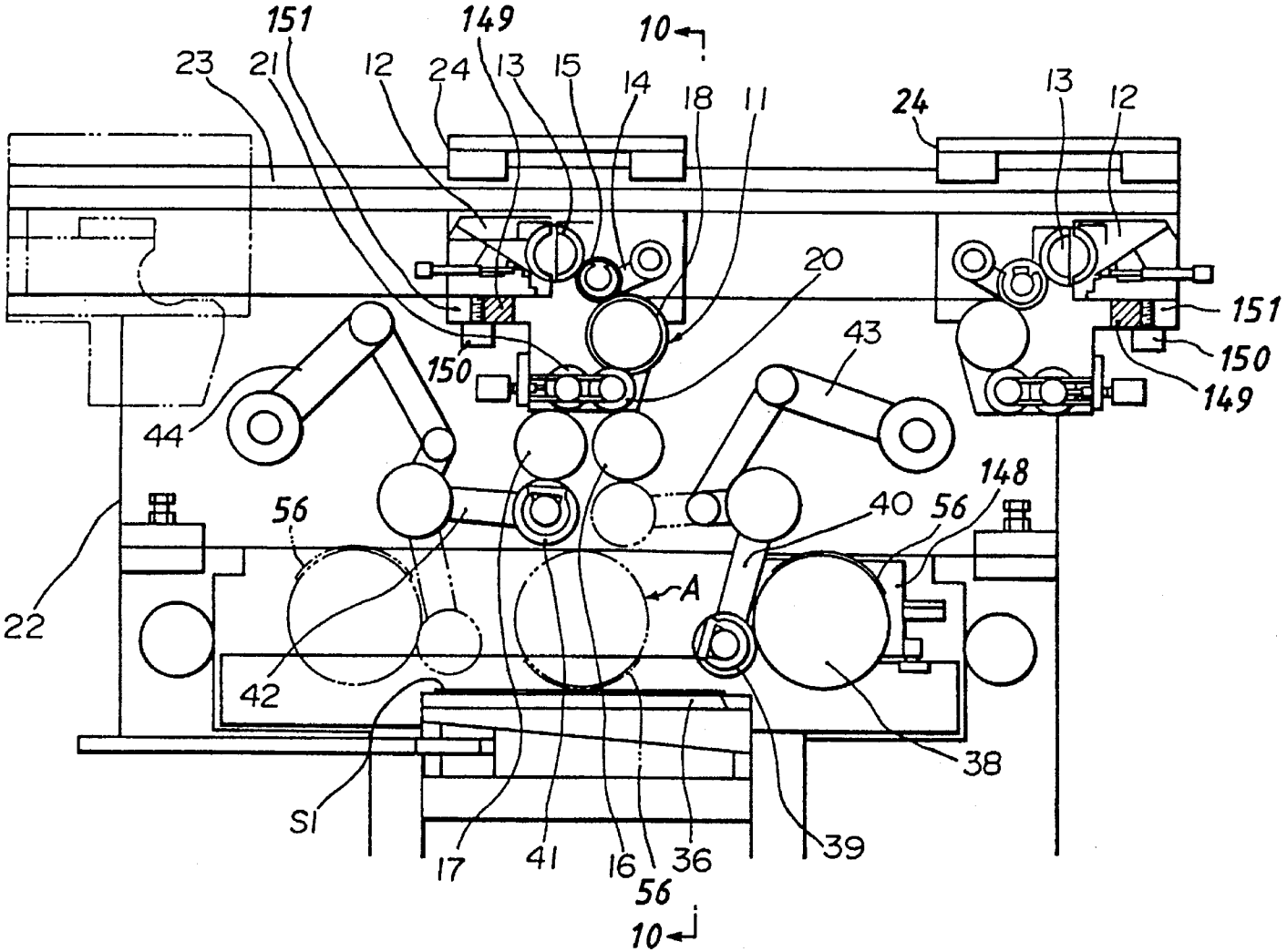
FIG. 8 is an enlarged sectional view of an important portion of a printing device of the present invention.
Figure 9:
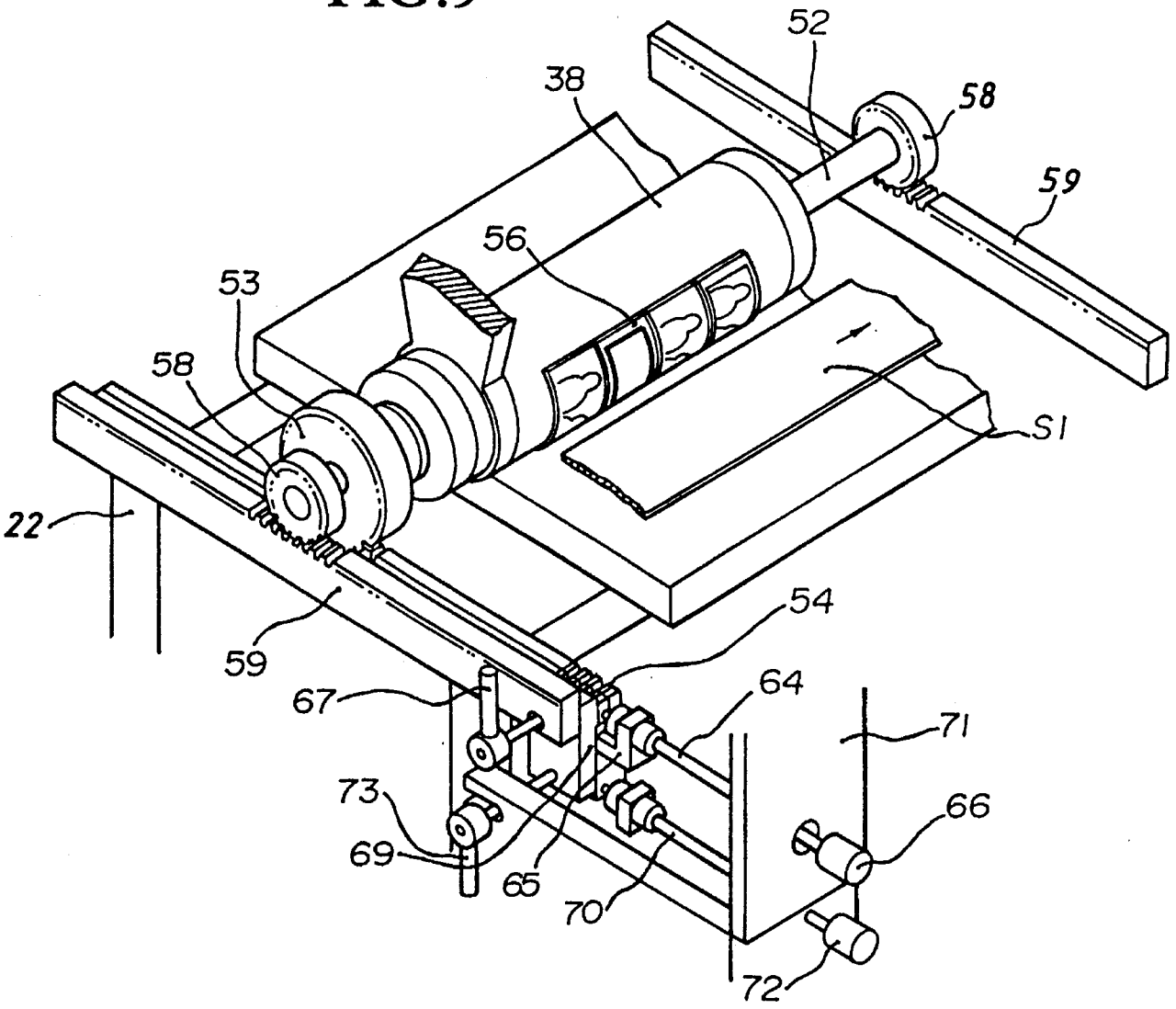
FIG. 9 is a perspective view around a printing impression roller of FIG. 8.
Figure 10:
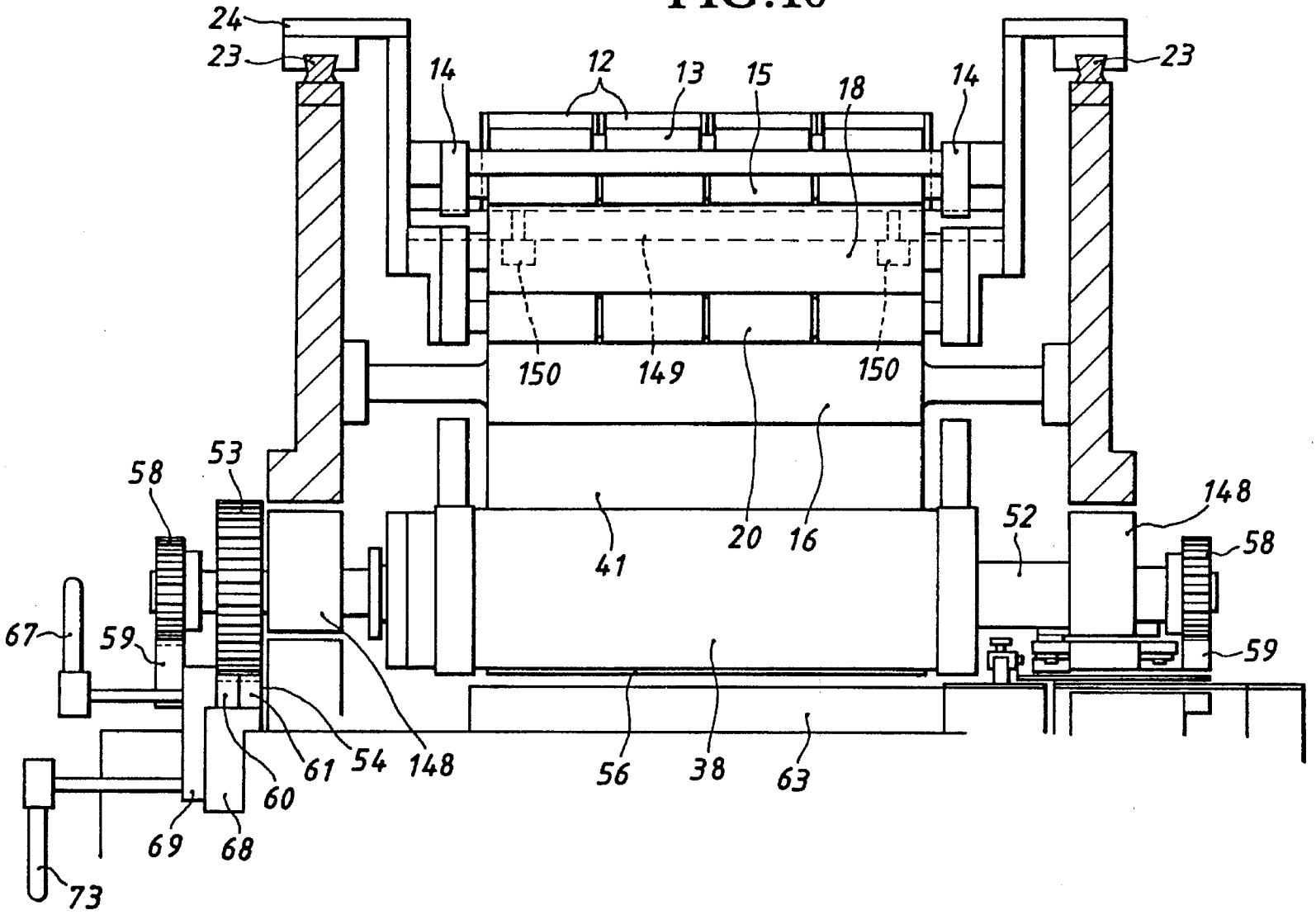
FIG. 10 is a sectional view taken along the line 10—10 in FIG. 8.

As shown in FIGS. 8, 9 and 10, the printing device 3 has a printing impression roller 38 which reciprocates, while rotating on the printing surface of the strip-like printing article S1, in a direction perpendicular to the direction of feeding or processing in which the printing article S1 is fed on a printing pressuring base 36. A printing block 56 which has, e.g., four printing stamps is fixed to the peripheral surface of the printing impression roller 38 by an adhesive agent. The printing block 56 is applied or coated with inks from ink tanks 12 which are located upwards via a roller train 11, two ink rollers (or inking rollers) 16, 17, and two freely rotational form rollers (or ink application rollers) 39, 41. These ink rollers 16, 17 are made of metal and are disposed in parallel with a roller shaft of the printing impression roller 38 at a distance thereabove. In case of four-color printing, as is conventionally known, the printing block 56 has four stamps corresponding to respective colors. The ink tanks 12 are provided in four in number, containing therein respective colors.

The printing article S1 is intermittently fed, like in the conventional printing device of this kind, by repeating the feeding and the stopping. While the printing article S1 is stopped, the printing of four colors is performed when the printing impression roller 38 moves forwards while rotating in one direction or backwards while rotating in the opposite direction on (i.e., in contact with) the surface of the printing article S1. The distance of this feeding is the one corresponding to the distance of one frame plus the distance or clearance between the frames. Intermittent feeding is performed by a feeding device as schematically represented by a numeral 147 in FIG. 1. The printing impression roller 38 is moved forwards and backwards in the direction perpendicular to the direction of feeding of the strip-like printing article S1 by a driving belt (not illustrated) which moves metallic members 148, which are rotatably fitted onto a rotating shaft 52 of the printing impression roller 38, in the above-described perpendicular direction. A gear wheel 53 which is provided on the rotating shaft 52 is engaged with a rack mechanism 54 which is provided to extend in the above-described perpendicular direction. It is thus so arranged that, through this mutual engagement, the gear wheel 53 and the rotating shaft 52 are rotated to cause the rotation of the printing impression roller 38. The above-described mechanism of reciprocating movement and rotation of the printing impression roller 38 is the one already employed in the conventional printing device.

In a condition shown in FIG. 8, the printing impression roller 38 moves forwards from a right-hand side position shown by a thick line to a left-hand side position shown by a two-dot chain line while printing by rotation on the stationary strip-like printing article S1. When the printing article S1 is stopped again after being fed by a predetermined distance, the printing impression roller 38 is returned or moved backwards to the right-hand side position shown by the thick line while printing the strip-like printing article S1. Right before this printing impression roller 38 starts the forward movement, a form roller (or an ink application roller) 39 which was in contact with the ink roller 16 is swung, by a swinging movement of a supporting arm 40 whose operation is controlled by a cam mechanism 43, to such a position which is on the front side in the forward movement of the printing impression roller 38 and in which the form roller 39 comes into contact with the printing impression roller 38. The form roller 39 is thereafter pushed upwards into a position in which it comes into contact again with the ink roller 16, while it is being rotated by the forward movement and rotation of the printing impression roller 38. By the rotating contact with this form roller 39, the printing block 56 on the printing impression roller 38 can be smoothly applied with inks without shocks. When the printing impression roller 38 moves backwards, the other form roller 41 which was in contact with the other ink roller 17 is swung by a swinging movement of a supporting arm 42 whose operation is controlled by a cam mechanism 44, right before the printing impression roller 38 starts backward movement, into a position which is on the front side in the backward movement of the printing impression roller 38 and in which the form roller 41 comes into contact with the printing impression roller 38. In the same manner as at the time of forward movement of the impression roller 38, the inks are smoothly applied to the printing block 56 on the printing impression roller 38. One 16 of the ink rollers is rotated in the direction coinciding with that of the printing impression roller 38 at the time of its forward movement, and the other 17 of the ink rollers is rotated in the direction coinciding with that of the printing impression roller 38 at the time of its backward movement. Therefore, the form rollers 39, 41 which come into intermittent contact either with the impression roller 38 or with the respective ink rollers 16, 17 are brought into smooth contact with each other.

The roller train 11 for supplying the ink rollers 16, 17 with inks is made up of the following five rollers, i.e., an ink fountain roller (or bottling roller) 13 which is rotatably driven and is in contact at its peripheral surface with four ink tanks 12 for withdrawing inks therefrom, a freely rotatable rubber-make duct roller (or access roller) 15 which comes into intermittent contact with the peripheral surface of the ink fountain roller 13 for the purpose of receiving the inks, a fixedly positioned freely rotatable metallic roller 18 which comes into intermittent contact with the periphery of the duct roller 15 for the purpose of distributing (or kneading) the inks, a first ink distributing roller (or kneading roller) 20 of rubber make which rotates by keeping constant contact with the peripheral surface of the metallic roller 18 to thereby distribute the inks and which contacts also with one 16 of the ink rollers to thereby transfer the inks, and a second ink distributing roller (or kneading roller) 21 of rubber make which rotates by keeping constant contact with the peripheral surface of the first ink distributing roller 20 to thereby distribute the inks and which comes into rotatable contact with the other 17 of the ink rollers. The roller train 11 is rotatably mounted, at both ends of each roller, on a slide base 24 which slides along a pair of parallel rails 23 which are provided on a printing device main body 22 above the printing impression roller 38 in a direction perpendicular to the feeding direction of the printing article S1. In FIG. 8, the other of the pair of rails is disposed on a side of the Figure away from the reader. The duct roller 15 is rotatably mounted on a swingable supporting arm 14 in a freely rotatable manner and is so arranged that the swinging movement thereof causes the intermittent contact of the duct roller 15 with the ink fountain roller 13 and the metallic roller 18. The ink rollers 16, 17 are provided with driving means in the form of an electric motor (not illustrated). It is thus so arranged that the remaining rollers in the roller train 11 and the first and the second ink distribution rollers 20, 21 are rotated through a frictional rotational contact with the ink rollers 16, 17. It is of course possible to make an arrangement such that the ink rollers 16, 17 are rotated by other driving means and that the remaining rollers in the roller train 11 are rotated thereby.

Figure 11:
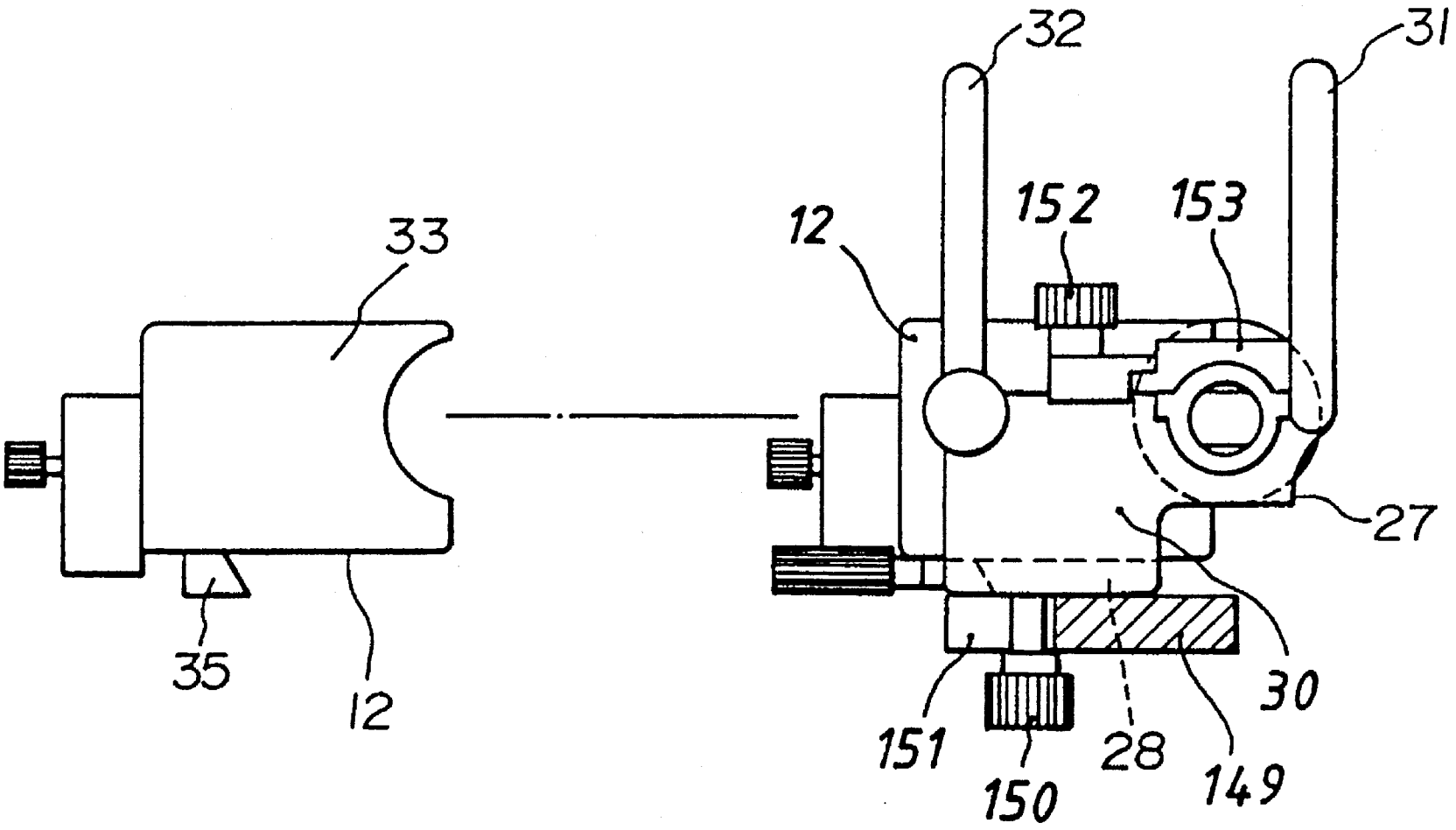
FIG. 11 is a side view of ink tanks and an ink fountain roller of an embodiment of the present invention.
Figure 12:
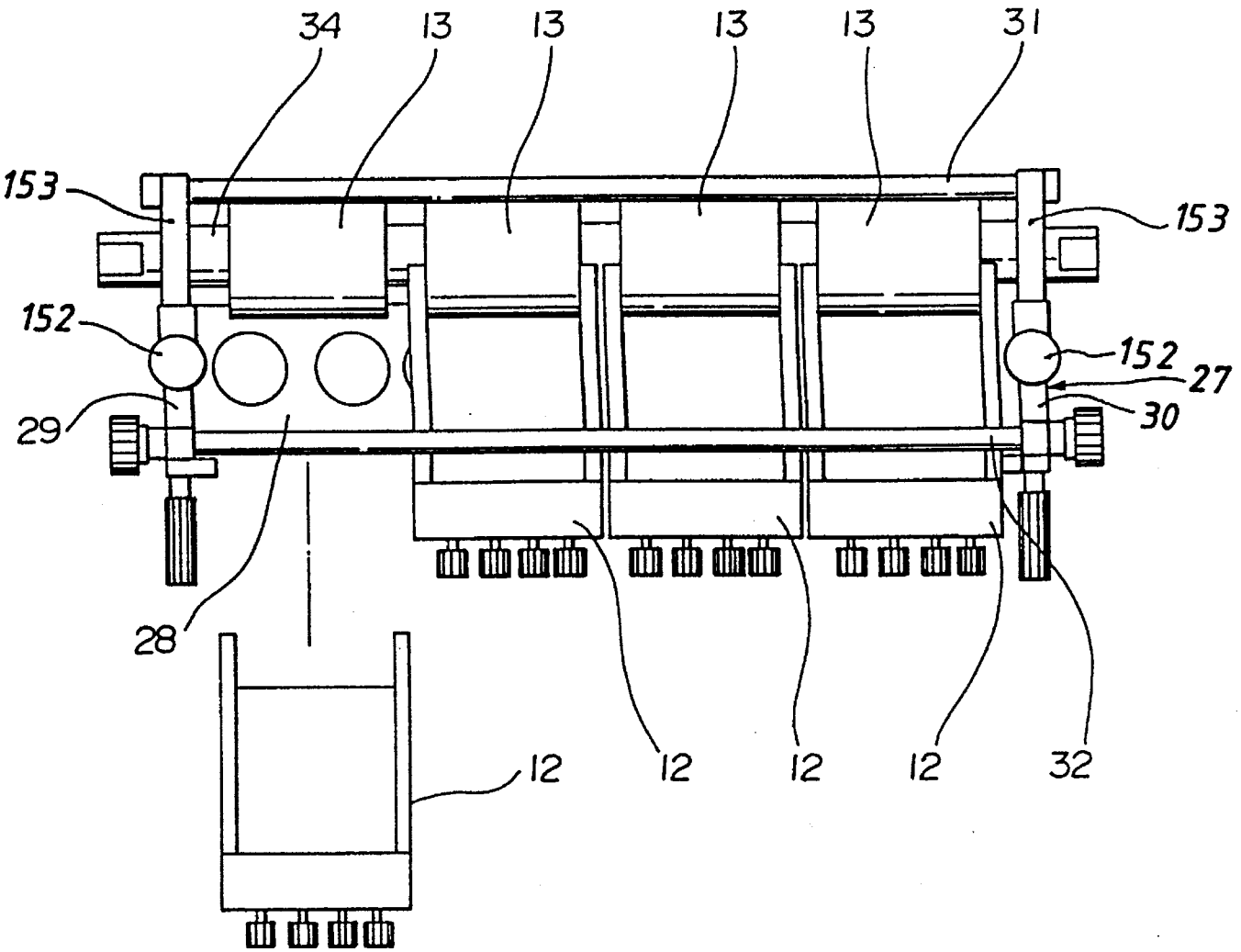
FIG. 12 is a plan view of the ink tanks and the fountain roller in FIG. 8.
Figure 13:
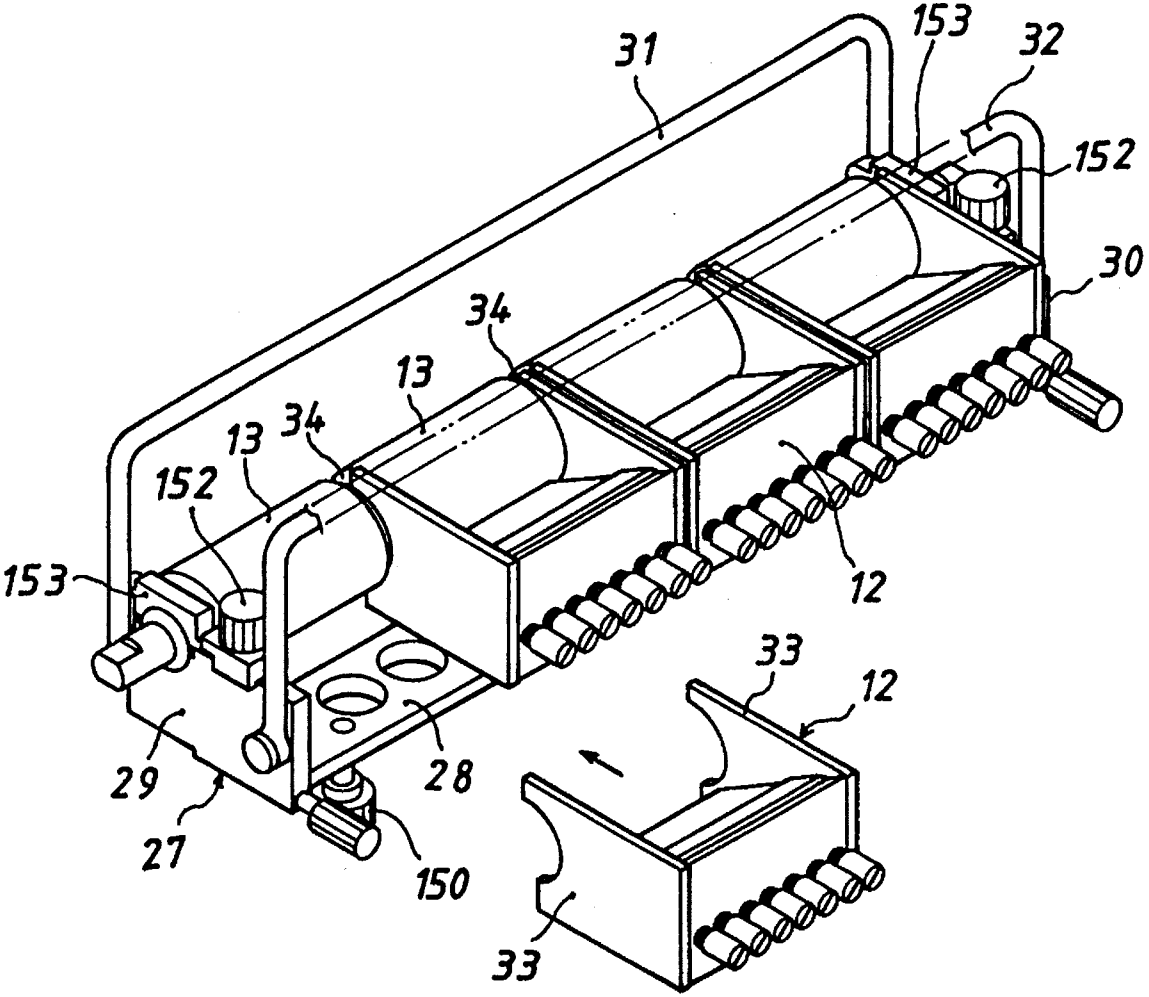
FIG. 13 is a partially exploded perspective view of the ink tanks with the ink fountain roller mounted thereon.

Since the roller train 11 is moved together with the slide base 24, the ink tanks 12 are also mounted on the slide base 24 so that the inks can be fed by constant contact with the ink fountain roller 13. In the illustrated embodiment, in order to maintain the mutual contacting relationship of the respective ink tanks and the ink fountain roller 13, they are mounted on a common frame 27 made up of side walls 29, 30 which are vertically fixed to both ends of a bottom plate 28 as shown in FIGS. 11, 12 and 13. The frame 27 is mounted on an ink tank base 149 of the slide base 24. There is formed in the ink tank base 149 a slot 151 for receiving therein a lock bolt 150 which projects out of the bottom plate 28 of the frame 27. It is thus so arranged that, when the frame 27 is mounted thereon, the frame 27 can be detachably fixed to the ink tank base 149 by fastening the lock bolt 150. Each of the ink tanks 12 is of substantially the same construction as a conventional one and has a box construction in which the side facing the ink fountain roller 13 is opened with the remaining three sides closed. The ink tank 12 has a bottom surface which is downwardly inclined towards the ink fountain roller 13. The side walls 33 which constitute the box construction are cut away in an arcuate shape. It is thus so arranged that, when the ink tanks 12 are mounted on the frame 27, the front ends of the cut-away portions advance into recessed grooves 34 which are formed in the periphery of the ink fountain roller 13. In other words, the periphery of the ink fountain roller 13 advances into the ink tanks 12 so as to be dipped into the inks contained therein. In order to restrict the mounting position of the ink tanks 12, there is provided on its bottom a stopper 35 which engages with the bottom plate 28 of the frame 27. The ink fountain roller 13 is rotatably mounted by means of a shaft cover 153 which is attached by a bolt 152 to the side walls 29, 30 of the frame 27. The ink fountain roller 13 is arranged to be removable out of the frame 27 by removing the shaft cover 153. The shaft end of the ink fountain roller 13 is rotated by connection to an electric motor for rotating it. The frame 27 is provided with handles 31, 32 for transporting purpose.

In case where only one set of slide base 24 is provided, the printing of the strip-like printing article is finished and then the printing of different colors, e.g., of three colors, can be made on the printing article in the following manner. First, the printing impression roller 38 is positioned in a position as shown by an alphabet A in FIG. 8. The duct roller is brought into contact with the metallic roller and, thus, bring all the rollers from the duct roller to the ink roller into consecutive contact with each other. While contacting a doctor blade (not illustrated) with the ink roller, the ink roller is rotated by changing its rotation from one direction of rotation to the opposite direction of rotation, thereby washing away the ink adhered to the roller by means of a washing agent. Then, the slide base 24 is slid along the rails 23 from the central position shown in FIG. 8 to a leftward waiting position as shown by a two-dot chain line. By this sliding movement the first ink distributing roller 20 is brought out of contact with the ink roller 16, and the second ink distributing roller 21 is brought out of contact with the ink roller 17. In this slid position the ink tanks 12 and the ink fountain roller 13 which is integral therewith are taken out of the ink tank base 149 on the slide base 24. The duct roller 15 is taken out of the supporting arm 14 which is swingably disposed on the slide base 24. Further, the distribution rollers 20, 21 are taken out. The ink tanks 12 and the ink fountain roller 13 are replaced as a set with three ink tanks containing therein inks which are required next and a new ink fountain roller. The remaining three rollers that have been taken out are replaced with new ones which are prepared in advance after cleaning. The form rollers 39, 41 are also replaced with newly prepared ones, and another printing block 56 is mounted on the impression roller 38. Since the number of the rollers on the slide base 24 is small and since the replacement work and the cleaning work are carried out in a position moved sidewise from the printing position and by separating the connection with the ink rollers, the works are easy and the replacement and the cleaning can be completed in a shorter time. Further, since the ink rollers 16, 17 become free from obstacles on their upper sides by the movement of the slide base 24, the cleaning work of the neighborhood becomes easy.

Once the replacement work and the cleaning work have been finished, the slide base 24 is returned to the printing position, and the metallic roller 18, the ink distribution rollers 20, 21 and the ink rollers 16, 17 which are in mutual contact with each other are rotated at a higher speed than that at the time of printing. In this manner, ink distribution is carried out until the inks are coated uniformly on the respective rollers. This high-speed rotation is carried out by driving the ink distributing rollers 20, 21 or by driving the ink rollers 16, 17 by electric motors. The ink fountain roller 13 is rotated at a normal speed of rotation. The speed of rotation of the duct roller 15 which alternately comes into intermittent swinging contact with the ink fountain roller 13 and the metallic roller 18 becomes equal to the speed of rotation of the ink fountain roller 13 or the metallic roller 18 when duct roller 15 comes into contact with the ink fountain roller 13 and the metal roller 18. When the rollers that have been brought into contact with each other are rotated at a high speed, the inks may splash from the points of contacts. However, because the number of rollers that constitute the roller train 11 is small in number, the points of contacts are also small in number and therefore the splashing of the inks is small even if the roller train 11 is rotated at a high speed. The distribution of the inks can therefore be made quickly. Once the distribution of the inks has been finished, the speed of rotation of the roller train 11 is decreased to that at the time of ordinary printing, and the printing article S1 is intermittently fed as in the conventional method. During the stopping of the feeding, the printing impression roller 38 is moved forwards or backwards, thereby carrying out the printing on a new portion of the printing article through the rotation of the printing impression roller 38 in one direction and in the opposite direction.

If there are prepared two sets of slide bases 24 which are provided with ink tanks and rollers, it is possible to prepare, during the printing work, ink tanks and rollers that are scheduled to be used next. It follows, in this case, that the printing on the next new printing article can be made as soon as the replacement of the form rollers 39, 41, the cleaning of the ink rollers 16, 17 and the replacement of the printing block 56 have been made. The operating efficiency can thus further be improved.

As has been described hereinabove, the printing impression roller 38 is moved forwards and backwards by the driving belt which moves forwards and backwards by metallic members 148 which are mounted on the rotating shaft 52, in the direction perpendicular to the direction of feeding of the printing article S1. During its movement or transfer, the printing impression roller 38 is rotated in one direction and in the opposite direction through the engagement of the gear wheel 53, that is fixed to the rotating shaft 52, with the rack mechanism 54 which is fixed to extend in the direction of forward and backward movements of the printing impression roller 38. During the forward and backward movements of the printing impression roller 38, the printing block 56 on the periphery thereof is brought into contact with the surface of the printing article S1 whose feeding is stopped. In the actual printing work, however, the backlash of the rack mechanism 54 may increase as a result of wear with the lapse of time, with the result that there will occur a deviation in the printing position between the forward movement and the backward movement of the printing impression roller 38. It is therefore desired to prevent the deviation in the printing position by easily adjusting the backlash to an appropriate amount. There is a further desire to adjust the printing position relative to the strip-like printing article by moving the rack mechanism 54.

Figure 14:
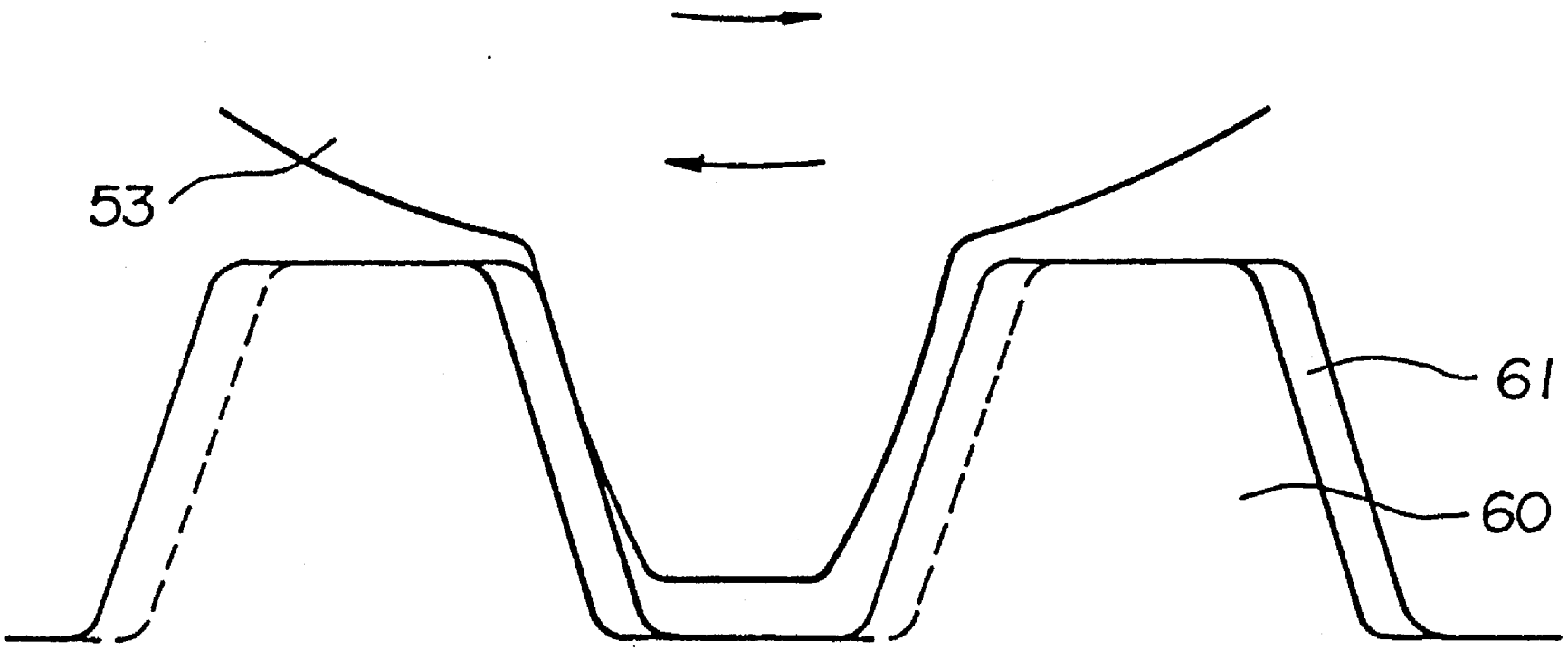
FIG. 14 is a diagram showing the mechanism of a rack mechanism shown in FIG. 9.

In order to meet the above-described former desire, the rack mechanism 54 has been arranged, as shown in FIGS. 9, 10 and 14, by a pair of first rack 60 and second rack 61 which are disposed in parallel with each other, and one of the racks is made to be movable in the longitudinal direction so that the backlash of the rack mechanism 54 as a whole can be adjusted. This kind of adjustment in the rack mechanism is known in Japanese Published Unexamined Patent Application No. 40154/1986. In the embodying example of the present invention, however, the following arrangement has been employed. Namely, at one end of the first rack 60 there is engaged a threaded bar 64 which extends via an L-shaped connection piece 65 that is integral with the second rack 61. The first rack 60 is made to be movable back and forth on a rack base 68 by the forward and backward movement of the threaded bar 64, thereby appropriately adjusting the backlash as shown in FIG. 14. The second rack 61 is fixed to the rack base 68. By this adjustment the gear wheel 53 which is integral with the printing impression roller 38 varies in its position of gear engagement with the rack mechanism 54 between the time when it moves forwards and the time when it moves backwards. As a result, even if the teeth have worn, the deviation in the printing position at the time of forward movement relative to the printing position at the time of backward movement can be adjusted to a value within an appropriate range.

Figure 15A:
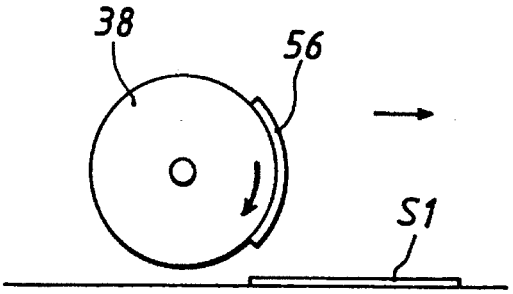
FIGS. 15A through 15C are diagrams showing the printing condition of the example given in FIG. 9.
Figure 15B:
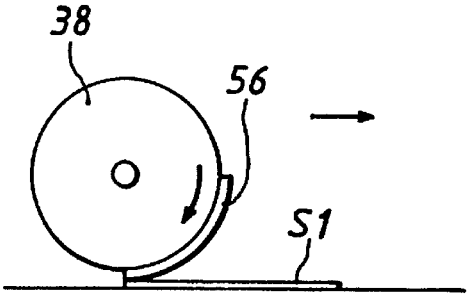
Figure 15C:
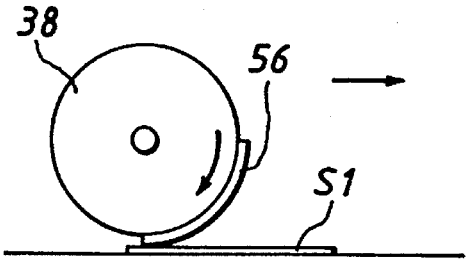

Further, in order to meet the latter desire, a front end of a threaded bar 70 which is connected in a threaded manner to a side plate 71 of the printing device main body 22 is engaged with an end portion of the rack base 68 having the rack mechanism 54. By the forward and backward movement of the threaded bar 70 the entire rack mechanism 54 is moved forwards and backwards together with the rack base 68. It is thus so arranged that the printing position relative to the strip-like printing article S1 can be adjusted by changing the phase of the printing impression roller 38. By thus adjusting the entire rack mechanism 54 by moving it, an adjustment can be made from a condition in FIGS. 15A and 15B in which an end of the strip-like printing article S1 is at the position of starting the printing to a condition in FIG. 15C in which the position of starting the printing is moved inward of the end of the printing article S1. This adjustment can advantageously be made easily without changing the position of mounting the printing block 56 on the printing impression roller 38.

On both ends of the rotating shaft 52 of the printing impression roller 38, there are provided gear wheels 58 that can slip via bearings. Each of the gear wheels 58 is made to be engaged with a rack 59 which is provided in parallel with the direction of movement of the impression roller 38 so that the rotary shaft 52 of the impression roller 38 can be parallelly moved forwards and backwards. The rack 59 is fixed to the printing device main body 22 via the side plate 69. At the end of the threaded bar 64 and at the end of the threaded bar 70 there are respectively provided dial gauges 66, 72 so that the amount of adjustment can be seen. A handle 67 is for fixing the first rack 60 to the second rack 61 and a handle 73 is for fixing the rack base 68 to the printing device main body 22.

Figure 16:
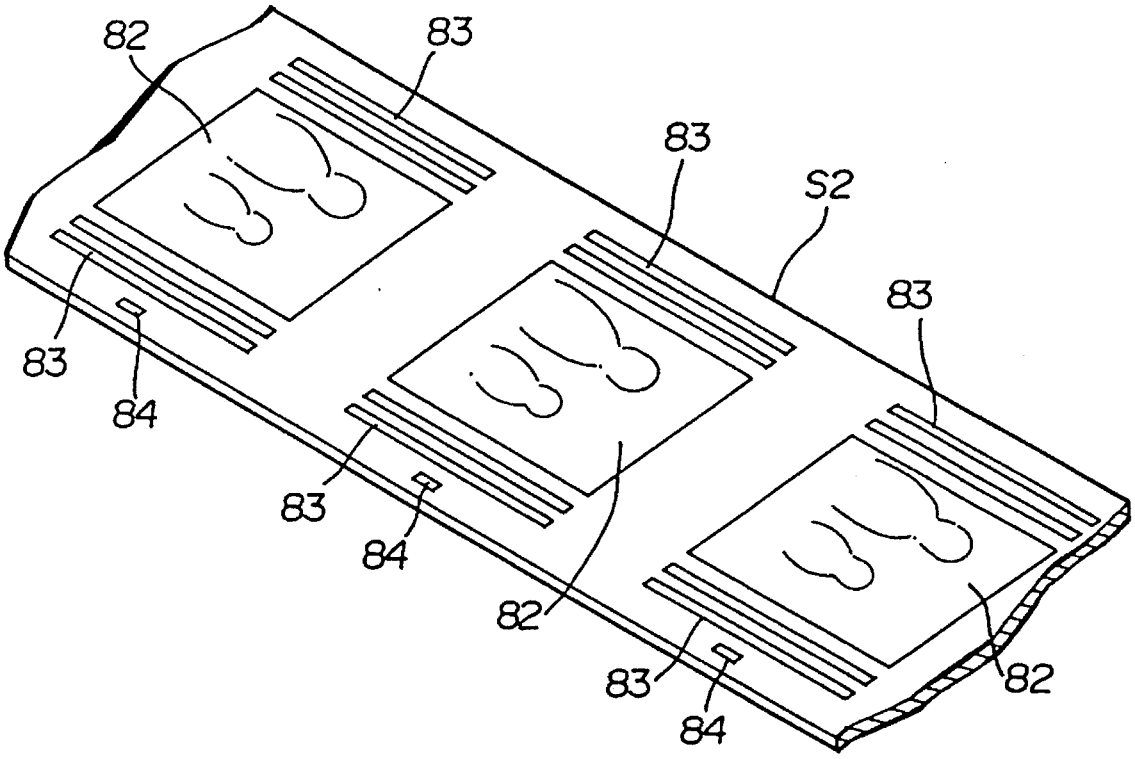
FIG. 16 is a perspective view of the strip-like printed article as printed by the printing device of the present invention.
Figure 17:
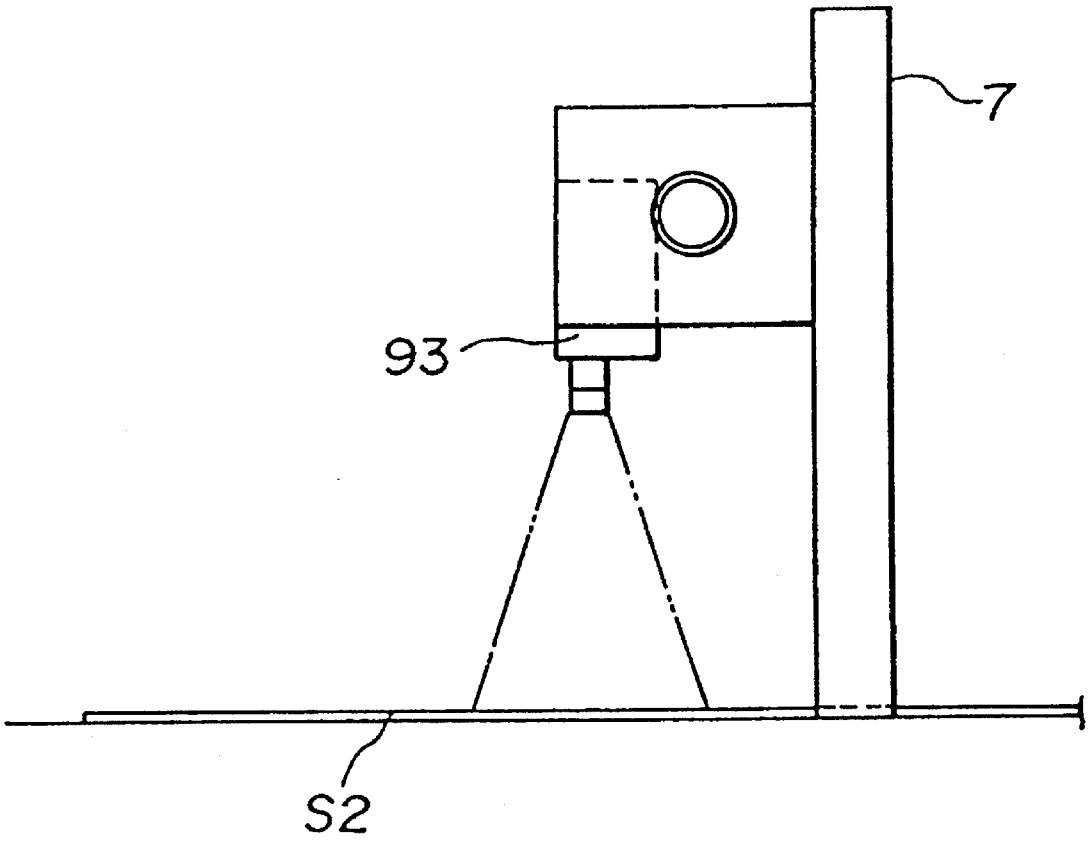
FIG. 17 is a side view of an image processing device attached to the printing device of the present invention.
Figure 18:
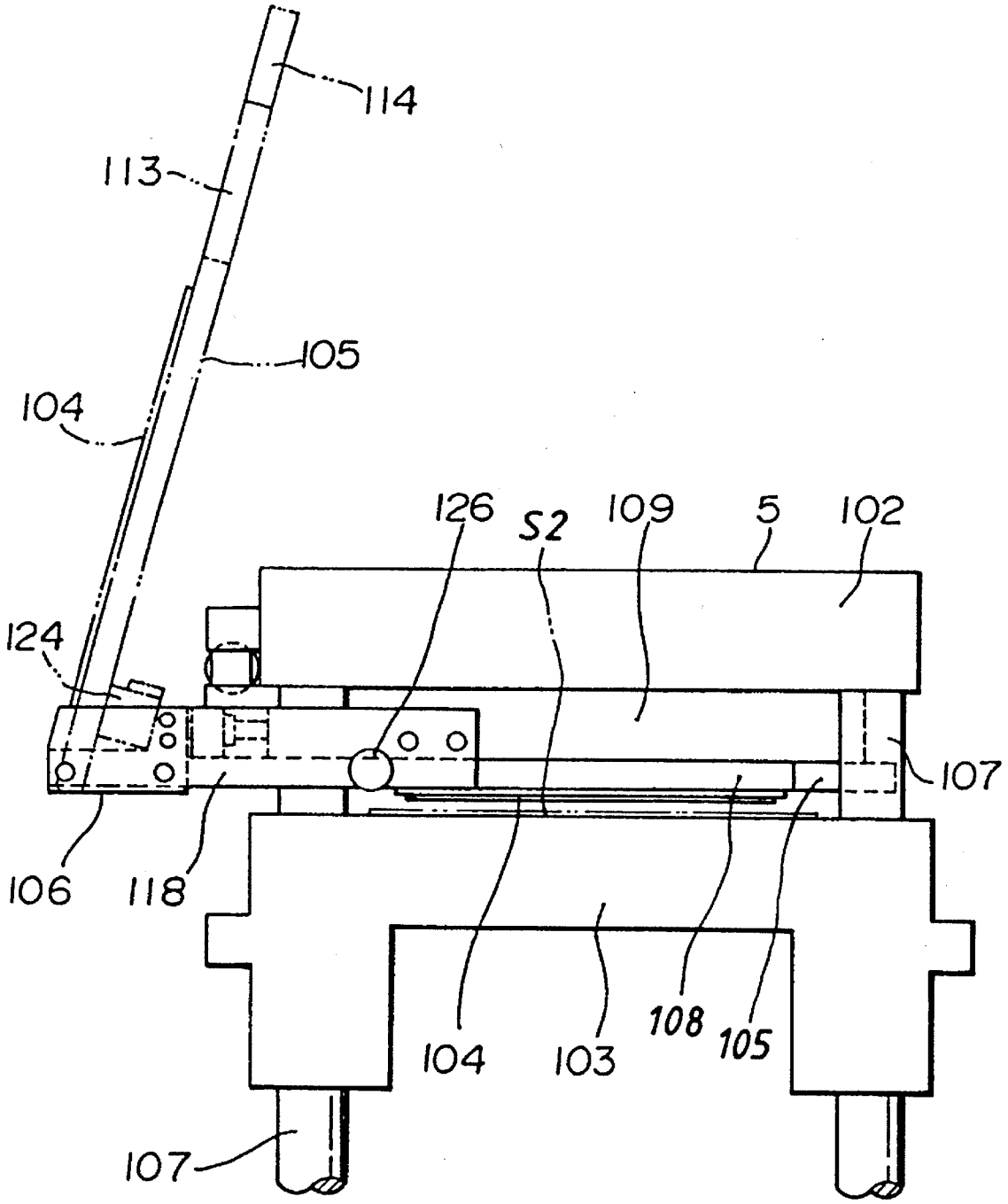
FIG. 18 is a front view of an important portion of a die-cutting device of the present invention.
Figure 19:
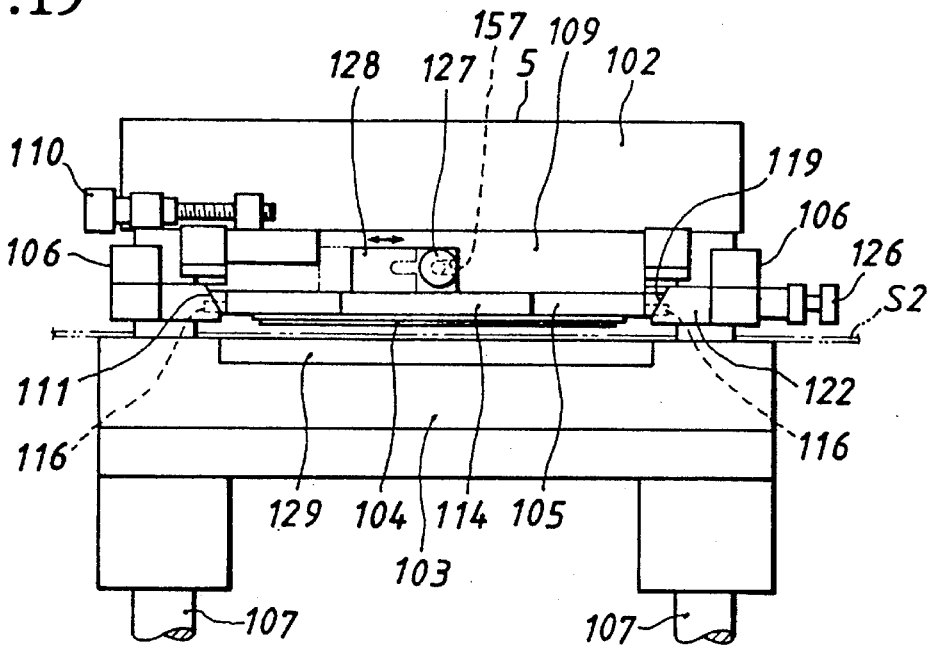
FIG. 19 is a left side view, partially omitted, of FIG. 18.

The strip-like printed article S2 to be obtained as a result of printing of the strip-like printing article S1 by the printing device 3 is subjected to drying of its inks in an unillustrated drying mechanism and is then laminated on its surface with a transparent adhesive film in the laminating mechanism 4 and is further intermittently fed to the die-cutting device 5. The position and condition of printing of the printing frames 82 printed on the strip-like printed article S2 are read out, on the way of the printed article S2 to the die-cutting device 5, by the image processing device (i.e., printing condition detecting device) 7 shown in FIGS. 1, 17 by reading density indicating portions 83 which are printed in a suitable peripheral position of each printed frame 82 and matching marks 84 as shown in FIG. 16. The read out data are compared with registered data to thereby judge whether they are appropriate. The image processing device 7 is made up of a CCD (charge coupled device) camera 93 and a computer (not illustrated). At the time of starting the printing work, the density data of the density indicating portions 83 and the position data of the matching marks 84 are registered in the computer. Those data and the density data in the density indicating portion 83 and the position data which are read out by the CCD camera 93 are compared with each other. If the deviation has exceeded the reference range (allowable range), an instruction for correction in color or correction in position is given by the image processing device 7. When the instruction for correction in color has been given, the amount of feeding the ink of each color from each ink tank 12 is adjusted and, when the instruction for correction in position has been given, the position of the cutting line 145 to be given by the die-cutting device 5 along the outline of the printing frame 82 is adjusted so that the cutting line 145 can be added precisely along the printing frame 82. In the example shown in FIG. 16, an arrangement has been made such that two bar-like density indicating portions 83 can be respectively provided on both sides of the printing frame 82 to cope with four colors.

Figure 22:
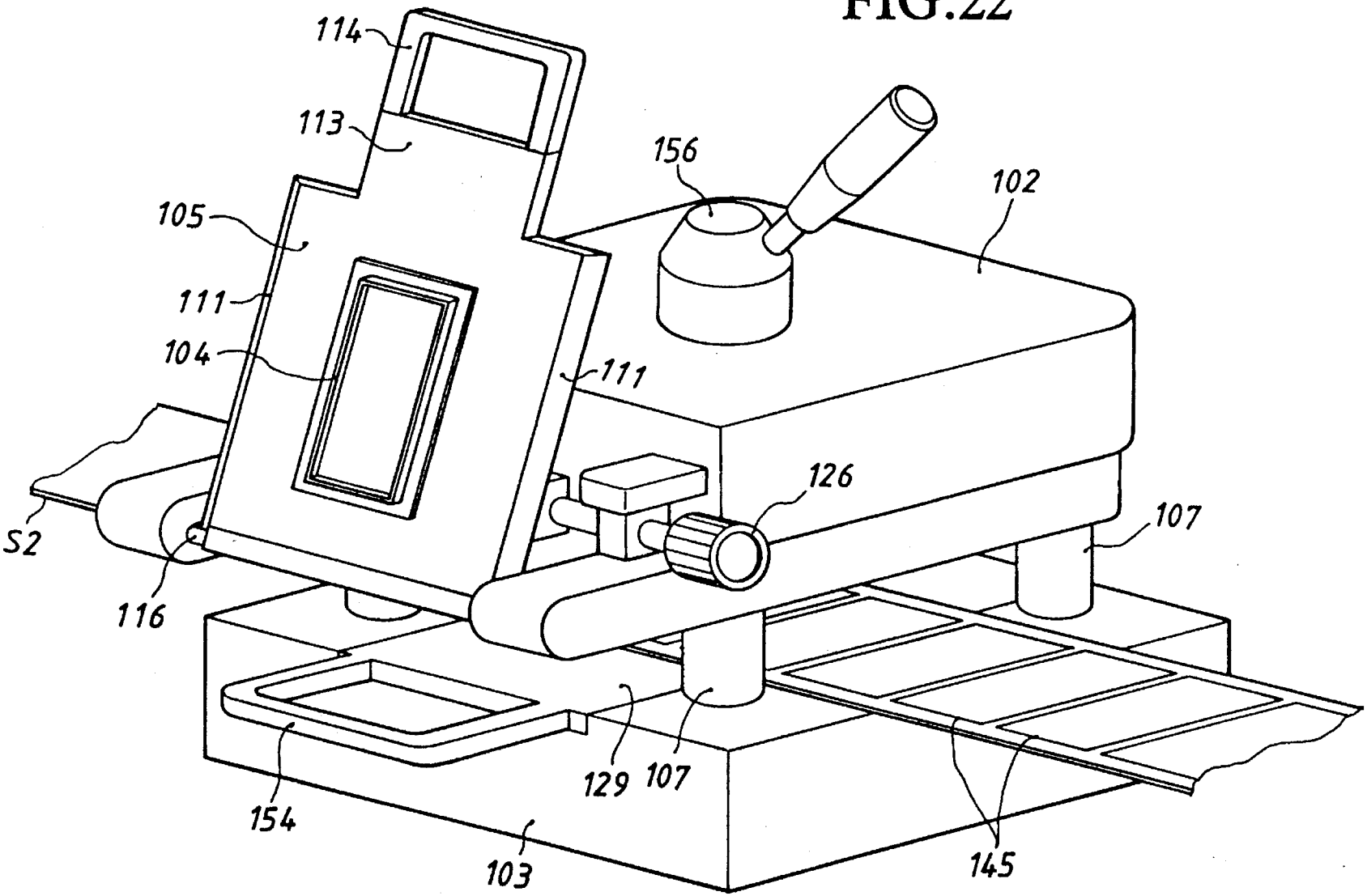
FIG. 22 is a perspective view of the die-cutting device of the present invention.
Figure 23:
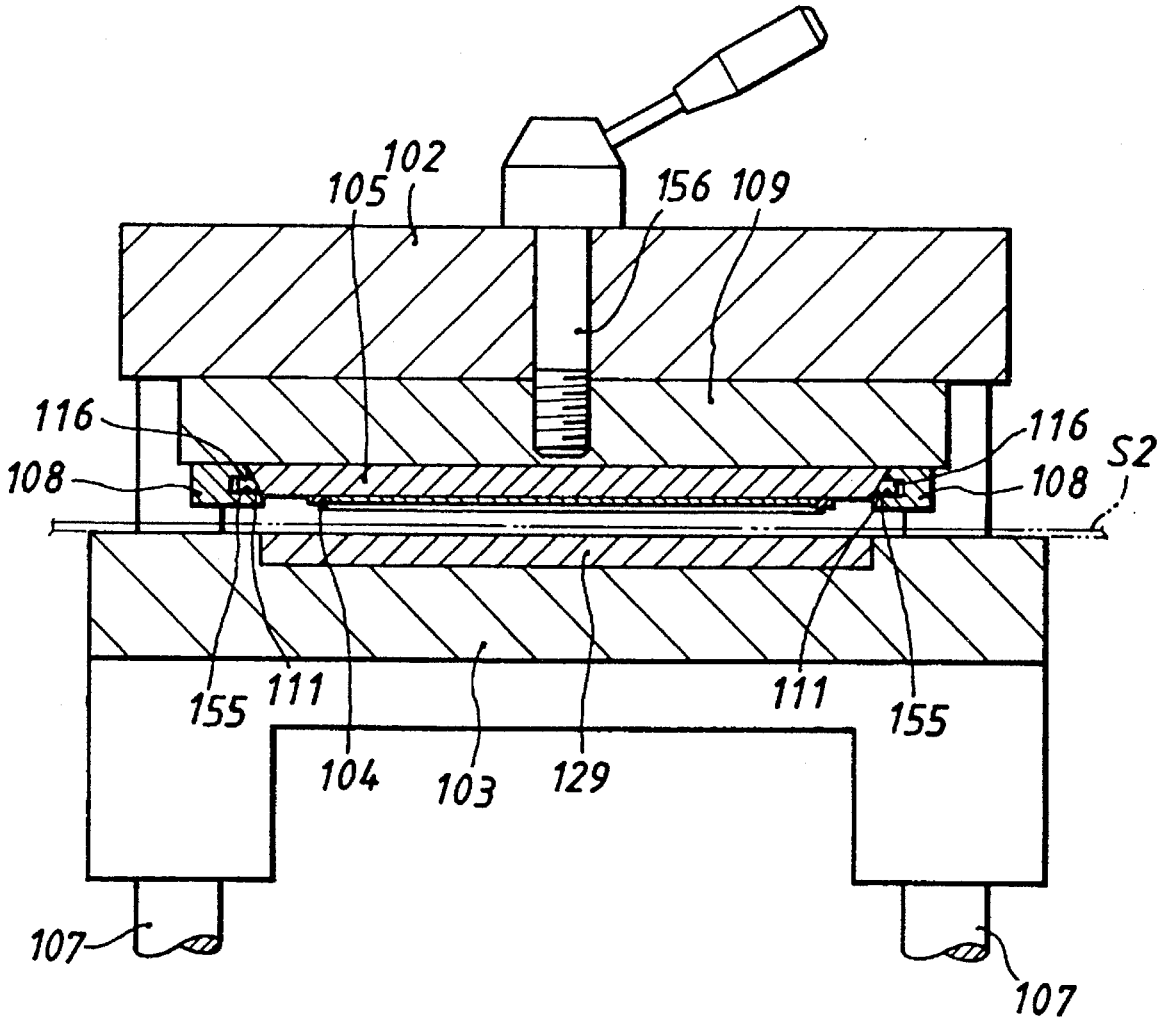
FIG. 23 is a sectional view taken along the line 23—23 in FIG. 20.

The die-cutting device 5 is made up, as shown in FIGS. 18 through 23, of a stationary lower frame 103 which supports the strip-like printed article S2 to be intermittently fed, and an upper frame 102 mounted on four supporting columns 107 which extend upwards through the lower frame 103 and are movable up and down, the upper frame 102 being positioned above the printed article S2. To an upper surface of the lower frame 103 there is attached a lower chase plate 129 of steel make. To a lower surface of a rotatable plate 109, there is attached an upper chase plate 105 of thick steel plate make. The upper chase plate 105 is provided on its lower surface with a punching blade 104. The rotatable plate 109 is rotatable about a bolt 156 provided on the lower surface of the upper frame 102. Namely, the upper chase plate 105 is attached to the upper frame 102 via the rotatable plate 109 and moves up and down together with the upper frame 102. On those both ends or edges of the upper chase plate 105 which lie or extend perpendicular to the feeding direction of the strip-like printed article S2, there are respectively formed downwardly inclined sliding portions 111 (or sliding portions inclined to converge downwards) as shown in FIG. 23. The sliding portions 111 are arranged to be slidably supported by upwardly inclined surfaces (or surfaces inclined to diverge upwards) of a pair of right and left guide rails 108 which are provided along the lower surface of the rotatable plate 109. The punching blade 104 is attached to the upper chase plate 105 by adhering a base plate of the punching blade 104. In the upper chase plate 105 there is formed by extension a handle portion 113 as shown in FIG. 22 and a handle 114 for handling the upper chase plate 105 is provided at an end portion of the handle portion 113. A handle 154 for handling the lower chase plate 129 is also provided on the lower chase plate 129.

Figure 20:
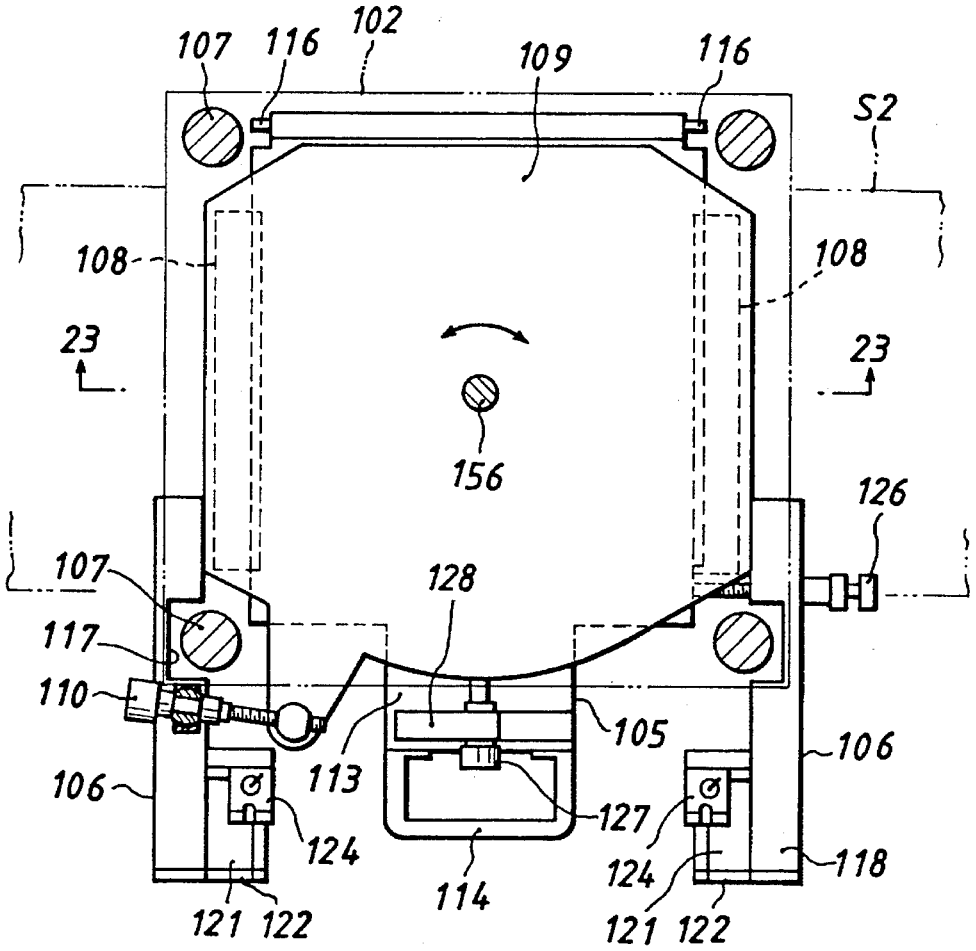
FIG. 20 is a plan view, partially omitted, of FIG. 19.
Figure 21:
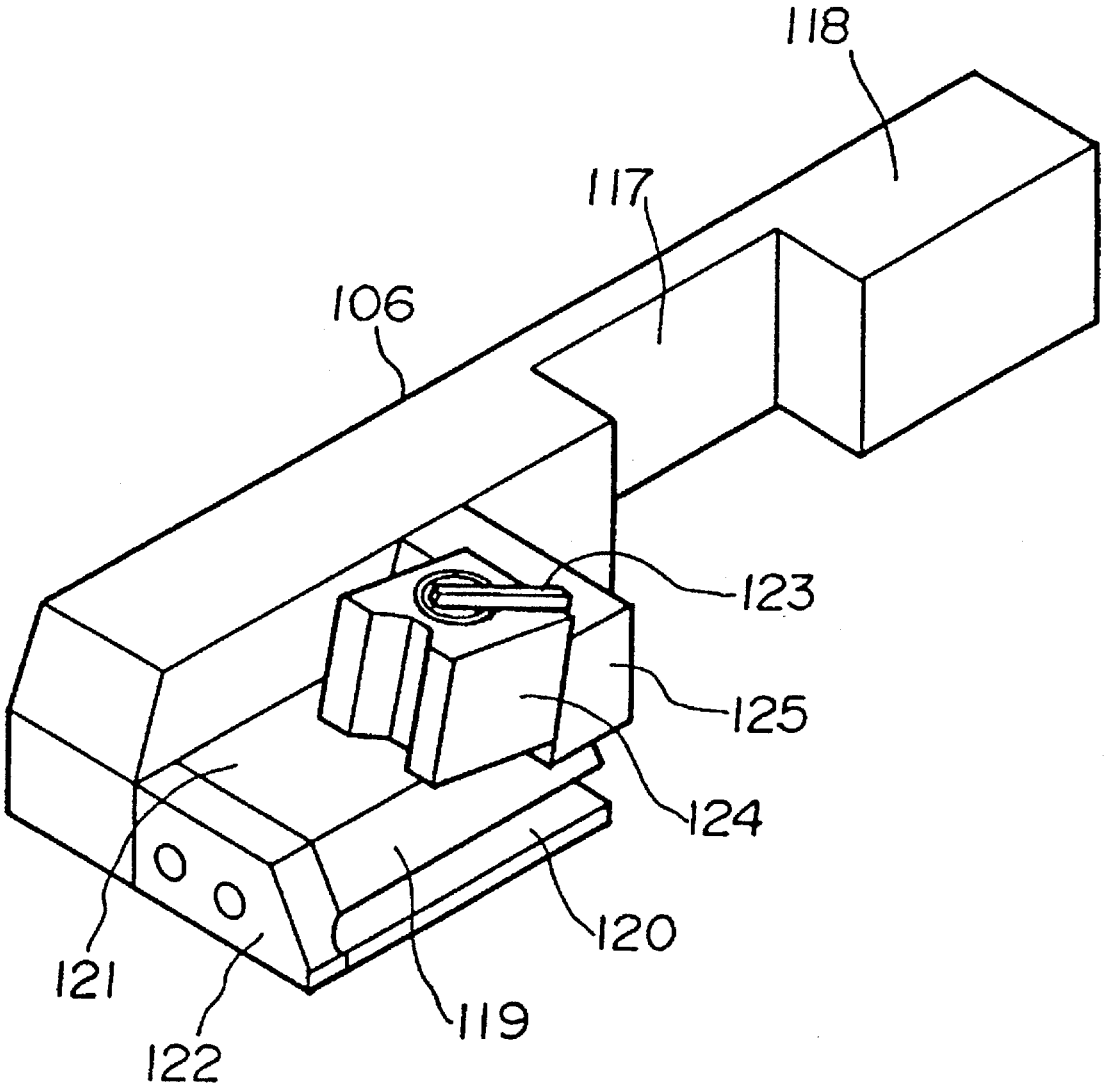
FIG. 21 is a perspective view of a slide arm portion of FIG. 20.

This kind of construction is substantially the same as that of a conventional die-cutting device. In case the cutting line 145 is changed according to the change in the shape and dimensions of the labels that have been printed on the strip-like printed article S2, it is necessary to replace the punching blade 104 by pulling out the heavy upper chase plate 105 from underneath the upper frame 102. This work requires a physical force and is accompanied by a possibility of its dropping out of position or onto the floor. In order to avoid this kind of possibility, an arrangement has been made in this embodiment such that the upper chase plate 105 can be pulled out along the guide rails 108 so that, as shown in FIG. 22, the punching blade 104 can be replaced by swinging the upper chase plate 105 upside down (or at least into a posture in which the lower surface thereof faces upwards). In order to enable this operation, there are provided a stopper shaft 116, as shown in FIG. 20, in a manner projecting on the right and the left sides of the rear end portion of the upper chase plate 105. In front of the guide rails 108 there are provided receiving portions 119 which support the sliding upper chase plate 105 at their side edges, as shown in FIGS. 18 through 21, as well as slide arms 106 which have groove portions 120 along which the stopper shaft 116 can slide. In front ends of the groove portions 120 there are further provided plate-like stoppers 122 which abut the stopper shaft 116 to stop the movement thereof. Further, on an upper portion of the slide arms 106, there are provided holding means 124 for supporting the rear surface of the upper chase plate 105 which is swung upside down about the stopper shaft 116, which has abutted the stoppers 122, until the lower surface having attached thereto the punching blade 104 faces substantially upwards.

In the illustrated example, each of the slide arms 106 is made up of a mounting arm 118 which is provided on each side of the rotatable plate 109 in parallel with the guide rails 108, and an arm main body 121 in which are formed the receiving portion 119 for supporting the slide portion 111 on each side edge of the upper chase plate 105, and the groove portion 120. The mounting arm 118 and the arm main body 121 are integrally constituted by a suitable means such as screws or the like. On the inclined surface of the guide rail 108 there is formed a groove portion 155 which allows the stopper shaft 116 of the upper chase plate 105 to pass through. Notches 117 provided in the mounting arms 118 are for clearing the supporting columns 107. The rotatable plate 109 is engaged with a front end portion of a rotation-adjustment bolt 110 rotatably attached to the upper frame 102. When the rotation-adjustment bolt 110 is rotated, the rotatable plate 109 is rotated about the tightening bolt 156 which is screwed by passing through the upper frame 102, whereby the positional relationship between the punching blade 104 and the strip-like printed article S2 is changed. In order to fix the upper chase plate 105 guided by the guide rails 108, there is provided a lock screw 126 which laterally urges a side surface of the handle portion 113 of the upper chase plate 105. Further, in order to adjust the position of the upper chase plate 105 on the guide rails 108, the following arrangement has been employed. Namely, a plate-like adapter 128 is attached to the upper chase plate 105 so as to be movable in the feeding direction of the printed article S2. The front end of that bolt 127 for setting the slide position which is rotatably inserted into a notch 157 formed on a side of the adapter 128, is screwed to the side surface of the rotatable plate 109. It is thus so arranged that the positional relationship of the upper chase plate 105 on the guide rails 108 can be set by the rotation of the bolt 127. The upper chase plate 105 can be pulled out by pulling the handle 114 after the adapter 128 has been moved away from the bolt 127 for setting the sliding position.

When the punching blade 104 is replaced, the following steps are followed. Namely, the lock screw 126 is first unscrewed and the adapter 128 is moved sidewise. Then, by pulling the handle 114 the upper chase plate 105 is pulled along the guide rails 108 until the stopper shaft 116 of the upper chase plate 105 abuts the stoppers 122 of the slide arms 106. The upper chase plate 105 is swung upside down about the stopper shaft 116 so that the lower surface to which the punching blade 104 is attached looks upwards. In this posture the rear surface of the upper chase plate 105 is stably supported by the block-like supporting means 124. Therefore, it is possible to remove the punching blade 104 out of the upper chase plate 105 without difficulty to thereby perform the work of replacement to a punching blade of new dimensions and shape. In the illustrated example, the supporting means 124 is constituted by a magnet block which is magnetized by the changing over of a magnetic changeover lever 123 so that the reversed upper chase plate 105 can be supported by attraction through a magnetic force. Each of the supporting means 124 is fixed to a supporting plate 125 which is fixed to the slide arm 106.

Figure 24:
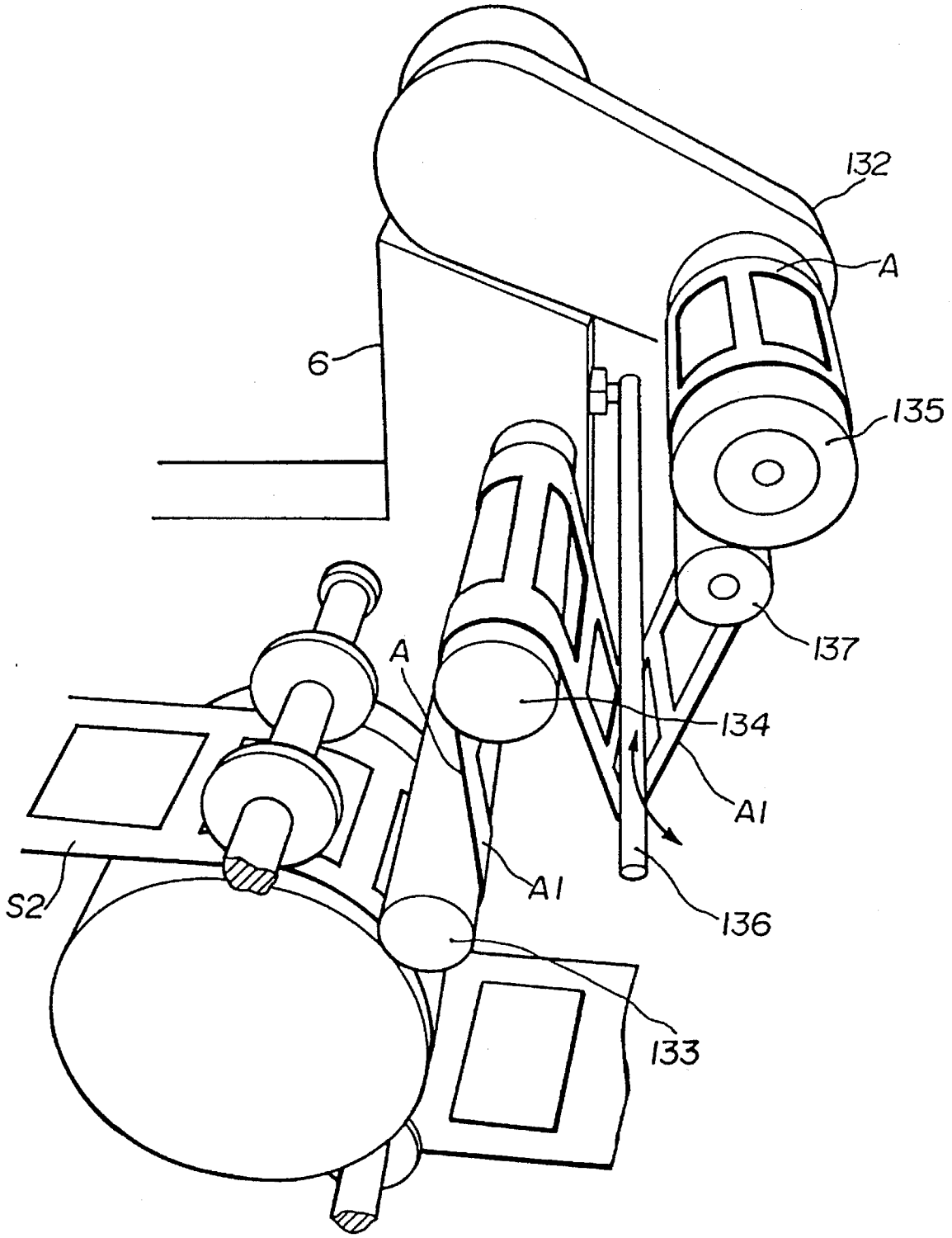
FIG. 24 is a perspective view of an important portion of a punched residue rolling device in FIG. 1.
Figure 25:
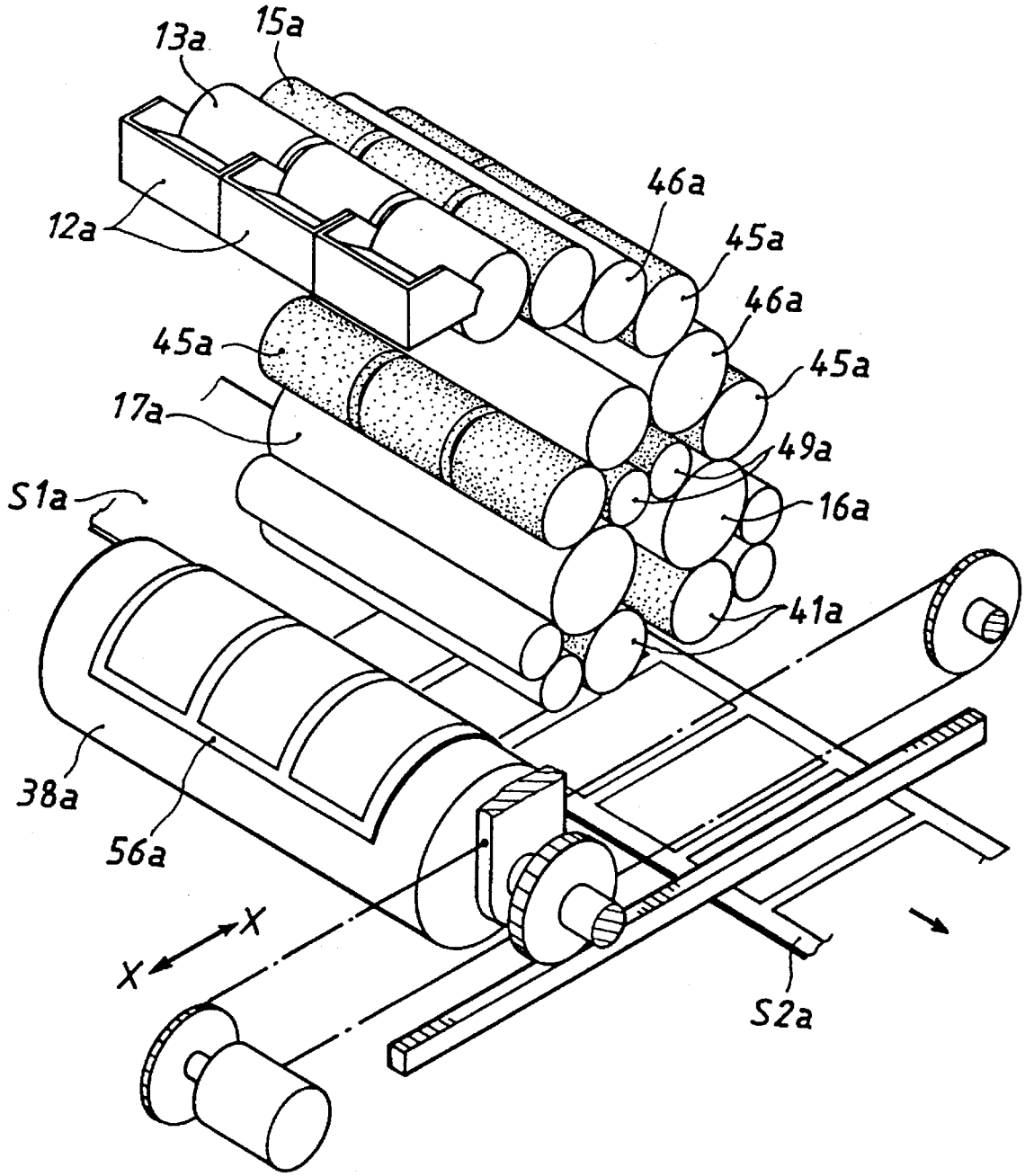
PRIOR ART FIG.25
FIG. 25 is a perspective view of an important portion of a conventional printing device.
Figure 26A:
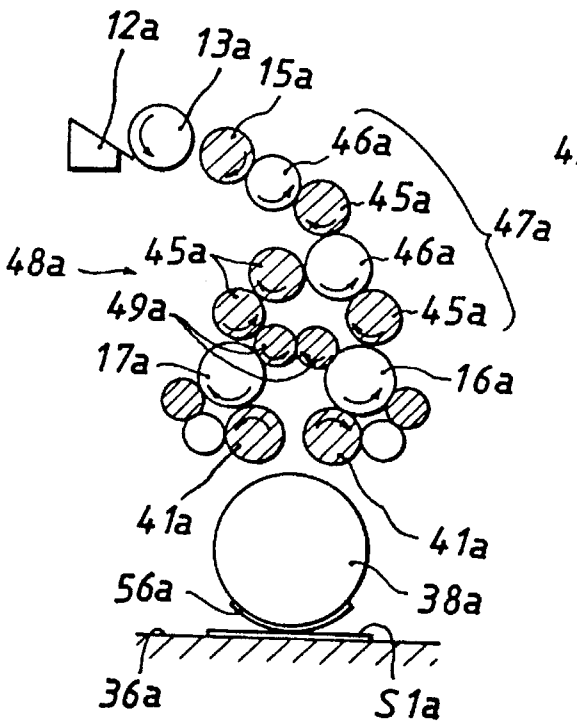
PRIOR ART FIG.26A
FIGS. 26A through 26C are diagrams explaining conventional roll trains.
Figure 26B:
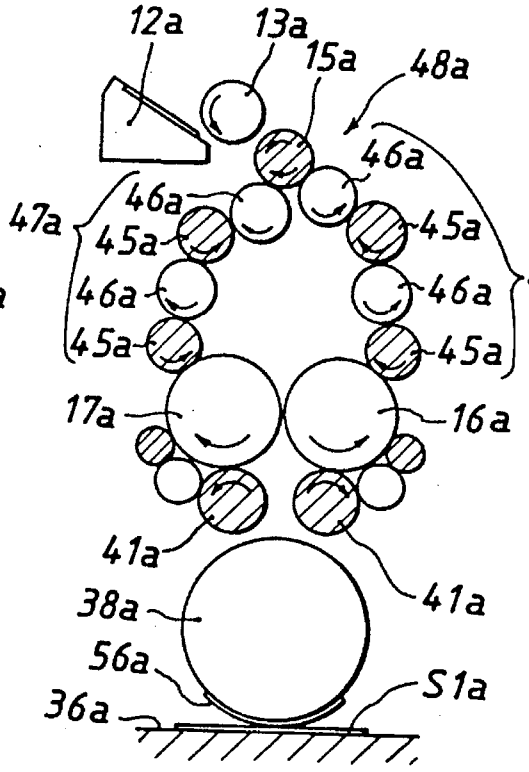
Figure 26C:
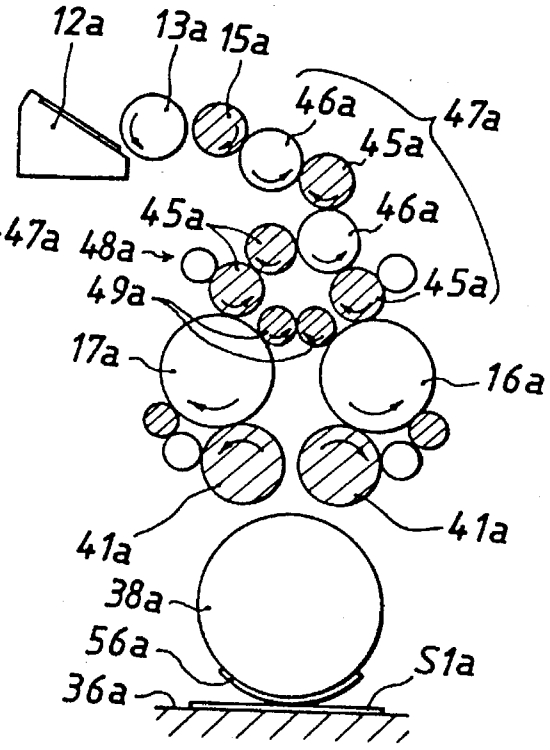
Figure 27:
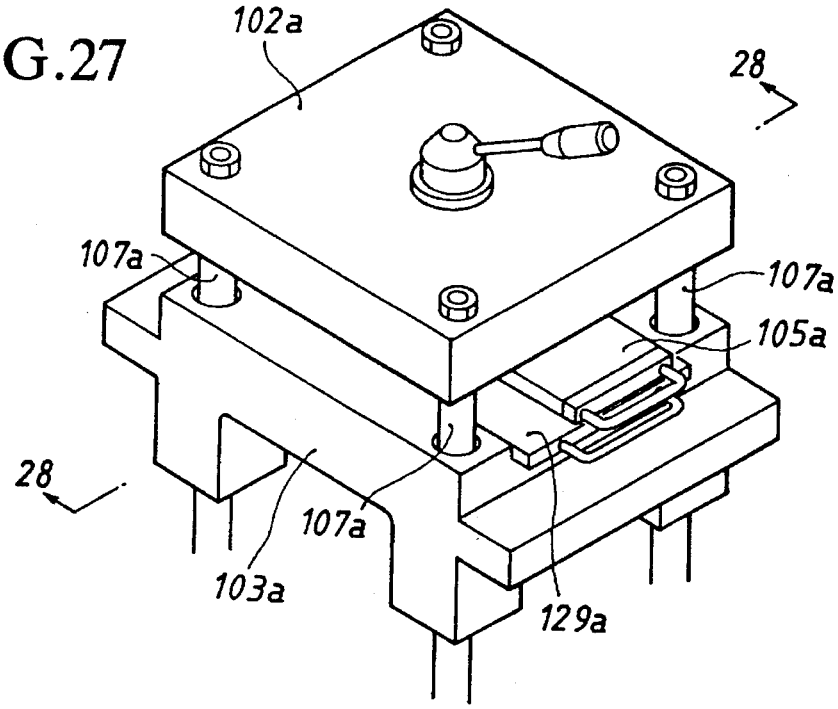
PRIOR ART FIG.27
FIG. 27 is a perspective view showing an important portion of a conventional die-cutting device.
Figure 28:
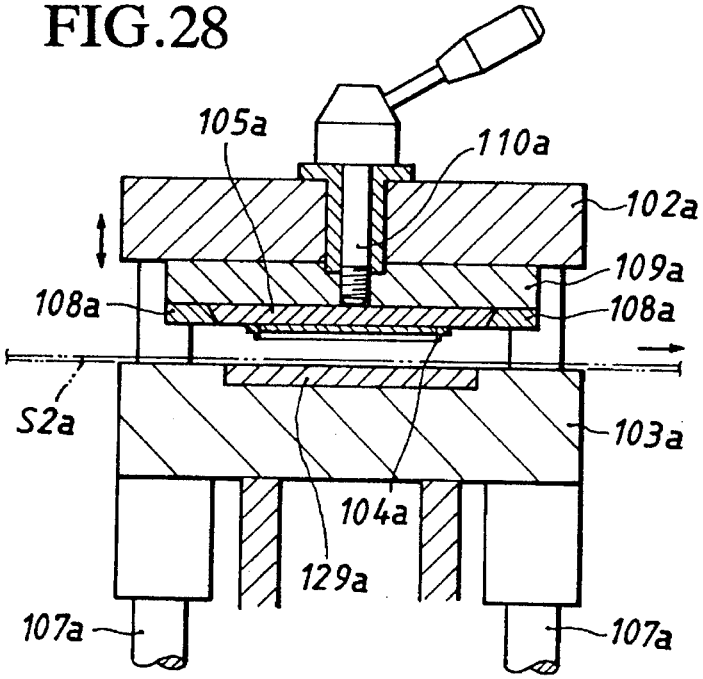
PRIOR ART FIG.28
FIG. 28 is a sectional view taken along the line 28—28 in FIG. 27.
Figure 29:
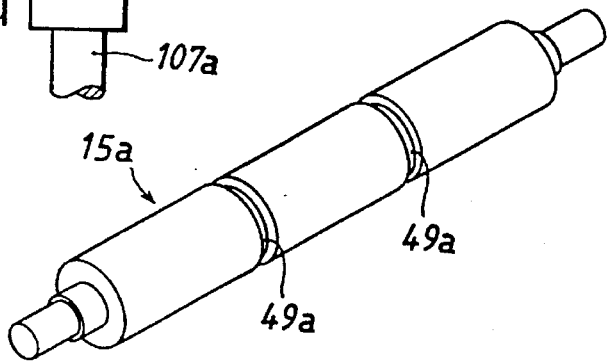
PRIOR ART FIG.29
FIG. 29 is a perspective view of a duct roller.

The upper chase plate 105 moves up and down together with the upper frame 102 which moves up and down when the intermittent feeding of the strip-like printed article S2 is stopped. The punching blade 104 cuts the laminated film, the printing paper and the adhesive agent layer along the outline of the printing frame 82 as shown in FIGS. 5 and 6. When the product in the form of labels is made out of the strip-like printed article S2, the unnecessary peripheral portion (i.e., punched residue A) other than the printing frames 82 is removed out of the released paper 140 as shown in FIG. 7. This removal is made by rolling it into the residue rolling device 6 which is located on the downstream side of a feeding roller 133 as shown in FIGS. 1 and 24. The product is rolled into the product rolling device 8 as shown in FIG. 1. The residue rolling device 6 is made up of a guide roller 134, a detection bar 136 for detecting the failure of supply of the residue, an auxiliary roller 137 and a winding roller 135 which is driven by a winding device 132. The punched residue A which has been separated at the feeding roller 133 from the strip-like printed article S2 by die cutting is wound up into the winding roller 135 with the surface A1 to which the adhesive agent is attached, positioned inside. The auxiliary roller 137 and the winding roller 135 are urged into contact with each other so as to rotate while giving a tension to the punched residue A. In case the punched residue A has been cut off, the detection bar 136 for detecting the failure of supply of the punched residue is operated to stop the operation of the entire printing device including the printing device 3.

As has been explained hereinabove, the printing device of reciprocating type according to the present invention has the following construction. Namely, there is provided the slide base on the rails which lie or extend perpendicular to the direction of feeding the strip-like printing article. On the slide base there are mounted the ink tanks and the roller train which is made up of the ink fountain roller which is in contact with the ink tanks, the duct roller which is in contact with the ink fountain roller, the metallic roller which is in contact with the duct roller, the first ink distribution roller which is in contact with the metallic roller, and the second ink distribution roller which is in contact with the first ink distribution roller. By the movement of the slide base the roller train and the ink rollers are brought out of contact with each other. Therefore, the replacement of the rollers and the cleaning of the rollers can be made in a shorter time. Since the number of rollers is small, the splashing of the inks is less and, therefore, the ink distribution can be completed in a shorter time by rotating the rollers at a higher speed of rotation. As a result, the operating efficiency of the printing device can be improved. The number of rollers to be prepared for replacement can be made small with the consequent smaller amount of cost for replacement. If the slide base is prepared in two sets in number, the operating efficiency can further be improved.

In addition, the die-cutting device of the present invention has the following construction. Namely, the stopper shaft is provided in a manner projecting towards the right and the left sides on the rear end portion of the upper chase plate. In front of the guide rails on which the upper chase plate slides, there are provided the receiving portions for supporting the side edges of the upper chase plate, and the slide arms in which are provided the groove portions to allow for the movement therein of the stopper shaft, as well as the stoppers, in front of the groove portions, for stopping the movement of the stopper shaft. On an upper portion of the slide arm there is provided a supporting means for supporting the rear surface of the reversed upper chase plate which is swung about the stopper shaft. Therefore, the replacement of the punching blade can be made without completely pulling out the heavy upper chase plate from the upper frame, and there is an advantage in that the replacement work can be eased and made safely.

It is readily apparent that the above-described printing device and the die-cutting device meet all of the objects mentioned above and have the advantage of wide commercial utility. It should be understood that the specific form of the invention hereinabove described is intended to be representative only, as certain modifications within the scope of the teachings will be apparent to those skilled in the art.

Accordingly, reference should be made to the following claims in determining the full scope of the invention.

What is claimed is:

1. In a printing device having:

a printing impression roller which is movable forwards while rotating in one direction and backwards while rotating in an opposite direction, along a line perpendicular to a direction of feeding a strip-like printing article to be fed from a paper feeding device, such that printing on the printing article is performed intermittently during the forward and backward movements of said printing impression roller;

a pair of ink rollers which are provided above said printing impression roller at a distance therefrom in parallel with a shaft thereof;

a pair of form rollers which are swung to bring them into alternate contact with said printing impression roller and said pair of ink rollers, whereby an ink is applied by said form rollers to a printing impression of said printing impression roller;

a roller train having an ink fountain roller, a duct roller and ink distribution rollers, said rollers coming into consecutive contact with each other; and an ink tank disposed above said roller train in contact with a peripheral surface of said ink fountain roller, whereby the ink contained in said ink tank is fed to said ink rollers via said roller train;

the improvement which comprises a slide base which is slidable along rails which extend in a direction perpendicular to the direction of feeding of the printing article;

wherein said ink tank and said roller train are mounted on said slide base, wherein said roller train comprises said ink fountain roller, said duct roller whose peripheral surface is in contact with said ink fountain roller, a stationary metallic roller whose peripheral surface is in contact with said duct roller, a first ink distribution roller whose peripheral surface is in contact with said metallic roller, and a second ink distribution roller whose peripheral surface is in contact with said first ink distribution roller; and wherein the contact between said first ink distribution roller and said second ink distribution roller of said roll train with said ink rollers is separated by the movement of said slide base.

2. A printing device according to claim 1, wherein said ink tank and said ink fountain roller are detachably mounted on said slide base.

3. A printing device according to claim 1 or 2, further comprising a second slide base and wherein a second ink tank and a second roller train are mounted on said second slide base.

4. In a die-cutting device having:

an upper frame which is movable up and down;

an upper chase plate which is disposed under said upper frame so as to be movable into and from underneath said upper frame along a line perpendicular to a direction of feeding a printed article which is made up of a released paper and a printing paper disposed on top of the released paper via an adhesive agent, said movement being guided at both side edges of said upper chase plate by a pair of guide rails which are provided so as to be movable up and down together with said upper frame;

a stationary lower frame below said upper chase plate;

a lower chase plate which is disposed on said lower frame, wherein the printed article is intermittently moved through a space between said upper frame and said lower frame; and a punching blade for punching a printed frame of the printed article, said punching blade being attached to a lower surface of said upper chase plate, said punching being carried out, while the feeding of the printed article is stopped, by moving downwards said upper frame, thereby cutting the printed paper and the adhesive agent layer;

the improvement which comprises:

a stopper shaft which is provided in a manner projecting on right and left sides of an end portion of said upper chase plate;

a pair of slide arms which are provided in front of said guide rails, each of said slide arms having a receiving portion which slidably supports, by said side edges, said upper chase plate and a groove portion which extends in a direction of movement of said upper chase plate to allow for movement of said stopper shaft;

a stopper which is provided in a front end of said groove portion to stop the movement of said stopper shaft by abutment therewith; and holding means which is provided on an upper portion of each of said slide arms and supports a rear surface of said upper chase plate when said upper chase plate is swung about said stopper shaft, which is in abutment with said stopper, into a posture at which the lower surface to which said punching blade is attached faces substantially upwards.

5. A die-cutting device according to claim 4, further comprising a rotatable plate which is provided below said upper frame so as to be rotatable relative to said upper frame, and wherein said guide rails and said slide arms are mounted on said rotatable plate with a distance between each of the respective pairs.

* * * * *